US008636331B2

(12) United States Patent
Sugahara et al.

(10) Patent No.: US 8,636,331 B2
(45) Date of Patent: Jan. 28, 2014

(54) PRINTER AND NOZZLE MALFUNCTION JUDGMENT PROGRAM

(75) Inventors: Hiroto Sugahara, Aichi-ken (JP); Hirofumi Kondo, Tajimi (JP); Yuko Iwamura, Nagoya (JP); Hitomi Sadohara, Nagoya (JP)

(73) Assignee: Bother Kogyo Kabushiki Kaisha, Aichi-ken (JP)

( * ) Notice: Subject to any disclaimer, the term of this patent is extended or adjusted under 35 U.S.C. 154(b) by 374 days.

(21) Appl. No.: 12/711,084

(22) Filed: Feb. 23, 2010

(65) Prior Publication Data

US 2010/0214340 A1 Aug. 26, 2010

(30) Foreign Application Priority Data

Feb. 25, 2009 (JP) ..... 2009-041781

(51) Int. Cl.
*B41J 29/38* (2006.01)

(52) U.S. Cl.
USPC ..... 347/9; 347/5; 347/19

(58) Field of Classification Search
USPC ..... 347/9, 13, 16, 19, 5, 12, 15
See application file for complete search history.

(56) References Cited

U.S. PATENT DOCUMENTS

2010/0060682 A1* 3/2010 Akatsuka ..... 347/9
2010/0128074 A1 5/2010 Muto et al.

FOREIGN PATENT DOCUMENTS

| | | |
|---|---|---|
| JP | 9094950 | 4/1997 |
| JP | 2001270139 | 10/2001 |
| JP | 2002038063 | 2/2002 |
| JP | 2010-046991 | 3/2010 |
| JP | 2010-125605 | 6/2010 |

* cited by examiner

*Primary Examiner* — Lam S Nguyen
(74) *Attorney, Agent, or Firm* — Frommer Lawrence & Haug LLP

(57) ABSTRACT

A printer comprises an ink-jet head, and a control unit which has a judgment pattern printing control section. When a judgment pattern is printed, the judgment pattern printing control section allows the discharge of ink droplets of a second color to an area on which ink droplets of a first color are to be landed, before discharging the ink droplets of the first color having a small color difference with respect to a color of a medium. Accordingly, the ink discharge malfunction is reliably judged for the nozzle irrelevant to the color of the recording medium and the color of the ink discharged from the ink-jet head.

12 Claims, 15 Drawing Sheets

PRINTER AND NOZZLE MALFUNCTION JUDGMENT PROGRAM

CROSS REFERENCE TO RELATED APPLICATION

The present application claims priority from Japanese Patent Application No. 2009-041781, filed on Feb. 25, 2009, the disclosure of which is incorporated herein by reference in its entirety.

BACKGROUND OF THE INVENTION

1. Field of the Invention

The present invention relates to a printer for performing printing by discharging inks from nozzles, and a nozzle malfunction judgment program for judging whether or not any ink discharge malfunction arises in the nozzle or nozzles.

2. Description of the Related Art

Japanese Patent Application Laid-open No. 9-94950 discloses the printing of a test pattern composed of a plurality of longitudinal lines which are printed by discharging inks from all nozzles to a recording paper sheet, and a plurality of lateral lines which are arranged between the plurality of longitudinal lines, which connect the plurality of longitudinal lines to one another, and which are printed corresponding to the respective nozzles. In this case, the nozzle, in which the ink discharge failure arises, is specified depending on the printing failure of any lateral line included in the plurality of lateral lines to be printed in the test pattern.

Japanese Patent Application Laid-open No. 2002-38063 discloses a printer which is capable of discharging inks of a plurality of colors including a white ink from a printing head. In this case, when the printing is performed on a recording paper sheet having a color other than the white, then the white ink is discharged as an underlayer, and then the ink of another color is discharged to the position at which the ink droplets of the white ink are landed.

SUMMARY OF THE INVENTION

In order to perform the printing normally with the printer as described above as well, for example, it is considered that the execution of the following procedure is required. That is, the test pattern as described above is printed to specify the nozzle or nozzles in which the ink discharge failure arises in the discharge head, and the maintenance operation such as the purge or the like is performed for the nozzle or nozzles.

The present inventors have found out the following fact. That is, when the test pattern as described above is printed with the printer as described above on a white recording paper sheet which is generally used most frequently, the test pattern of the white ink is difficult to be observed, because the test pattern of the white ink, which is printed on the recording paper sheet, has approximately the same color as that of the recording paper sheet (color difference is small). It is feared that the nozzle, in which the ink discharge failure arises, cannot be specified correctly.

An object of the present teaching is to provide a printer and a nozzle malfunction judgment program capable of printing a judgment pattern which makes it possible to reliably judge the ink discharge malfunction in a nozzle or nozzles irrelevant to a color of a recording medium and a color of an ink discharged from an ink jet head.

According to a first aspect of the present invention, there is provided a printer which performs printing by discharging, to a medium, inks of a plurality of colors including an ink of a first color which has a smallest color difference from a color of the medium and an ink of a second color which is different from the first color, the printer including:

an ink-jet head which is formed with a plurality of nozzles including a plurality of first nozzles through which the ink of the first color is discharged and a plurality of second nozzles through which the ink of the second color is discharged; and a control unit which controls operation of the ink-jet head, the control unit including a judgment pattern printing control section which controls the ink-jet head while printing a first judgment pattern which indicates whether or not ink discharge malfunction arises in the first nozzles, the judgment pattern printing control section controlling the ink-jet head so that ink droplets of the second color are discharged from the second nozzles to an area of the medium, and that then ink droplets of the first color are discharged from the first nozzles toward the area of the medium on which the ink droplets of the second color are landed to print the first judgment pattern on the area.

In this specification, the term "discharge malfunction" or abnormal discharge refers to, for example, the ink discharge failure, the bending of the ink discharge direction caused when the ink is discharged in a state in which any foreign matter adheres to the surroundings of the nozzle or nozzles, and the splash of the ink droplets. The term "area on which the ink droplets are landed" is the area disposed at the inside of the outer edge portion provided in order to land the ink droplets thereon. That is, it is a matter of course that the area on which the ink droplets are landed includes the area on which the ink droplets are actually landed. The words of "the area on which the ink droplets are landed" also includes the area on which the ink droplets are intended to be landed from the nozzle or nozzles when the ink discharge malfunction arises in the nozzle or nozzles and the ink is not discharged therefrom.

If only the ink of the first color, which has the smallest color difference with respect to the color of the medium, is discharged to the medium, and the first judgment pattern is printed thereby, then it is feared that the first judgment pattern may be hardly observed, and it is impossible to correctly judge whether or not the discharge malfunction arises.

However, in the present teaching, the ink of the second color different from the first color is discharged to the recording medium, and then the ink of the first color is discharged to the area of the recording medium on which the ink droplets of the second color have been landed to print the first judgment pattern. Therefore, it is possible to judge whether or not the discharge malfunction of the ink of the first color arises depending on whether or not the ink of the second color is exposed in the first judgment pattern. Accordingly, it is possible to correctly judge whether or not the ink discharge malfunction arises in relation to the nozzle or nozzles for discharging the ink of the first color having the small color difference as compared with the color of the recording medium.

According to a second aspect of the present invention, there is provided a nozzle malfunction judgment program for judging whether or not ink discharge malfunction arises in a nozzle in relation to an ink-jet head which is formed with a plurality of nozzles through which inks of a plurality of colors are discharged to a medium, the inks including an ink of a first color which has a smallest color difference from a color of the medium and an ink of a second color which is different from the first color, and the nozzles including a plurality of first nozzles and a plurality of second nozzles through which the inks of the first color and the second color are discharged respectively, the nozzle malfunction judgment program comprising steps which allow a computer to execute:

a first judgment pattern printing step of printing, on the medium, a first judgment pattern indicating whether or not first color ink discharge malfunction arises in the first nozzles, the first judgment pattern printing step including:

a second ink discharge step of discharging ink droplets of the second color from the second nozzles to the medium by controlling the ink jet head; and a first ink discharge step of discharging the ink of the first color from the first nozzles to an area of the medium, on which the ink droplets of the second color are landed, by controlling the ink-jet head; and a first judging step of detecting a color of the first judgment pattern by controlling a color sensor which detects a color and judging whether or not the first ink discharge malfunction arises in the first nozzles based on a detection result obtained by the color sensor;

wherein under a condition that the second color is detected, by the color sensor, at a position at which ink droplets of the first color are to be landed in the first judgment pattern, it is judged that the first color ink discharge malfunction arises in the first nozzles.

If only the ink of the first color, which has the smallest color difference with respect to the color of the medium, is discharged to the medium, and the first judgment pattern is printed thereby, then it is feared that the first judgment pattern may be hardly observed, and it is impossible to correctly judge whether or not the discharge malfunction arises.

However, in the present teaching, the ink of the second color different from the first color is discharged to the medium, and then the ink of the first color is discharged to the area of the medium on which the ink of the second color has been landed to print the first judgment pattern. Therefore, it is possible to judge whether or not the discharge malfunction of the ink of the first color arises depending on whether or not the ink of the second color is exposed in the first judgment pattern. Accordingly, it is possible to correctly judge whether or not the ink discharge malfunction arises in relation to the nozzle or nozzles for discharging the ink of the first color having the small color difference as compared with the color of the medium.

BRIEF DESCRIPTION OF THE DRAWINGS

FIGS. 3A, 3B and 3C show judgment patterns printed by the printer shown in FIG. 1, respectively, wherein FIG. 3A shows a case in which all nozzles are normal, FIG. 3B shows a case in which the ink discharge malfunction arises in nozzles for discharging the white ink, and FIG. 3C shows a case in which the ink discharge malfunction arises in nozzles for discharging the black ink.

DESCRIPTION OF THE PREFERRED EMBODIMENTS

A preferred embodiment of the present teaching will be explained below.

Figure 1:
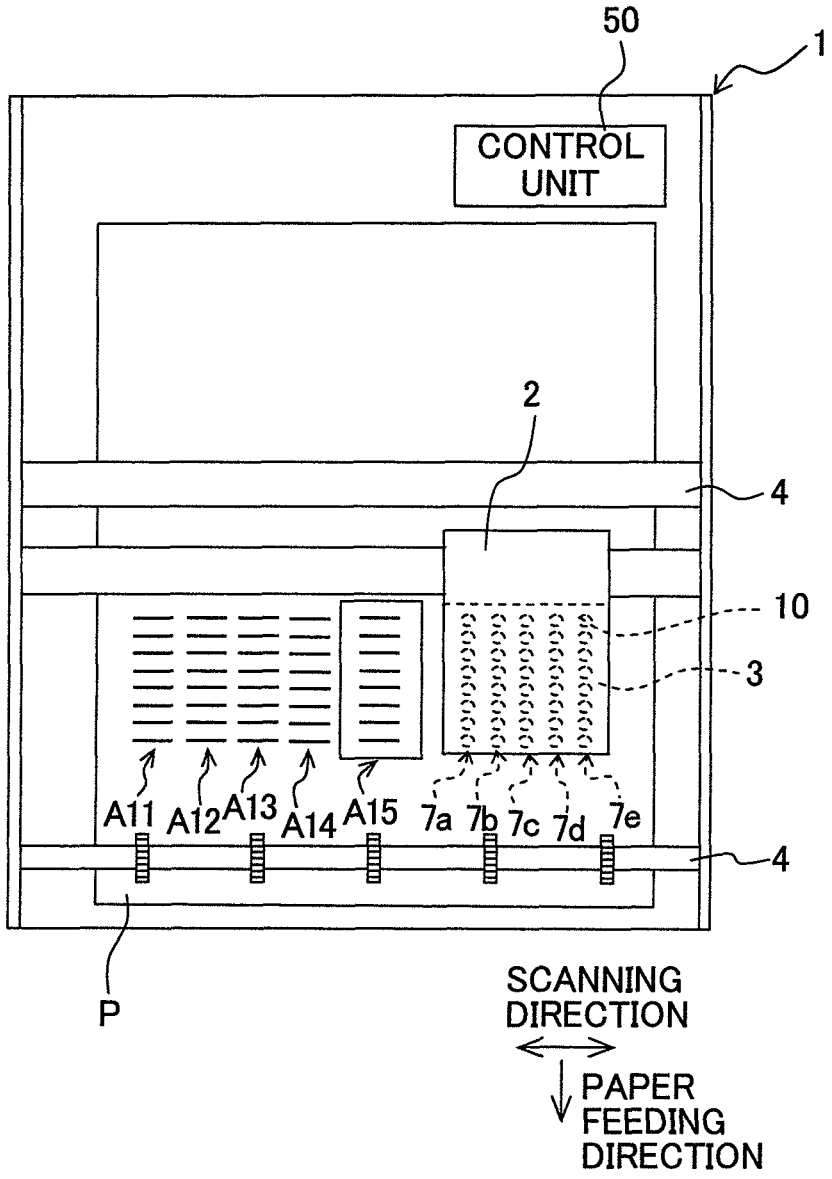
FIG. 1 schematically shows an arrangement of a printer according to an embodiment of the present invention.

As shown in FIG. 1, a printer 1 includes, for example, a carriage 2, an ink-jet head 3, transport rollers 4, and a driving mechanism 20. The printer 1 further includes a control unit (controller) 50. The operation of the printer 1 is controlled by the control unit 50.

The carriage 2 is reciprocatively movable in the left-right direction (scanning direction) as viewed in FIG. 1. The ink-jet head 3 is arranged on the lower surface of the carriage 2. Inks are discharged from a plurality of nozzles 10 formed on the lower surface thereof. The plurality of nozzles 10 are arranged in the upward-downward direction (paper feeding direction) as viewed in FIG. 1, to form nozzle arrays 7*a* to 7*e* respectively. The nozzle arrays 7*a* to 7*e* are arranged in the scanning direction.

In this arrangement, the inks of black (second color), cyan, magenta, yellow, and white (first color) are discharged from the nozzles 10 which constitute the nozzle arrays 7*a* to 7*e* respectively. That is, the ink jet head 3 has the five types of nozzles 10 which discharge the inks of the mutually different colors. In this embodiment, the nozzle array 7*a* corresponds to the second nozzle group according to the present teaching, and the nozzle array 7*e* corresponds to the first nozzle group according to the present teaching.

The transport rollers 4 are arranged at positions disposed at an upstream side and a downstream side of the ink-jet head 3 respectively as shown in FIG. 1. The recording paper P (recording medium) is transported in the downstream direction (paper feeding direction) as viewed in FIG. 1.

In the printer 1, the inks are discharged from the nozzles 10 of the ink-jet head 3 which is reciprocatively moved in the scanning direction together with the carriage 2 by being driven by the driving mechanism 20 onto the recording paper P which is transported in the paper feeding direction by the transport rollers 4. Accordingly, the printing is performed on the recording paper P.

In this process, when the white recording paper P, which is used most frequently, is used, the printing is performed by discharging the inks of the colors (black, cyan, magenta, and yellow) other than the white. When the recording paper P, which has a color other than the white, is used, the printing is performed by discharging the inks of all of the colors including the white from the nozzles 10. Accordingly, when the color of the recording paper P is white, the area of the recording paper P, on which the ink droplets are not landed, is the white area. When the color of the recording paper P is any color other than the white, the area of the recording paper P, on which the white ink droplets are landed, is the white area. Therefore, any image, which includes the white area, can be printed irrelevant to whether or not the color of the recording paper P is white.

In addition to the ordinary printing, the printer 1 can print a first judgment pattern A15 and second judgment patterns A11 to A14 to indicate whether or not the ink discharge malfunction, which includes, for example, the ink discharge failure and the bending of the ink discharge direction, arises in the nozzle or nozzles 10, on the recording paper P as described later on.

Figure 2:
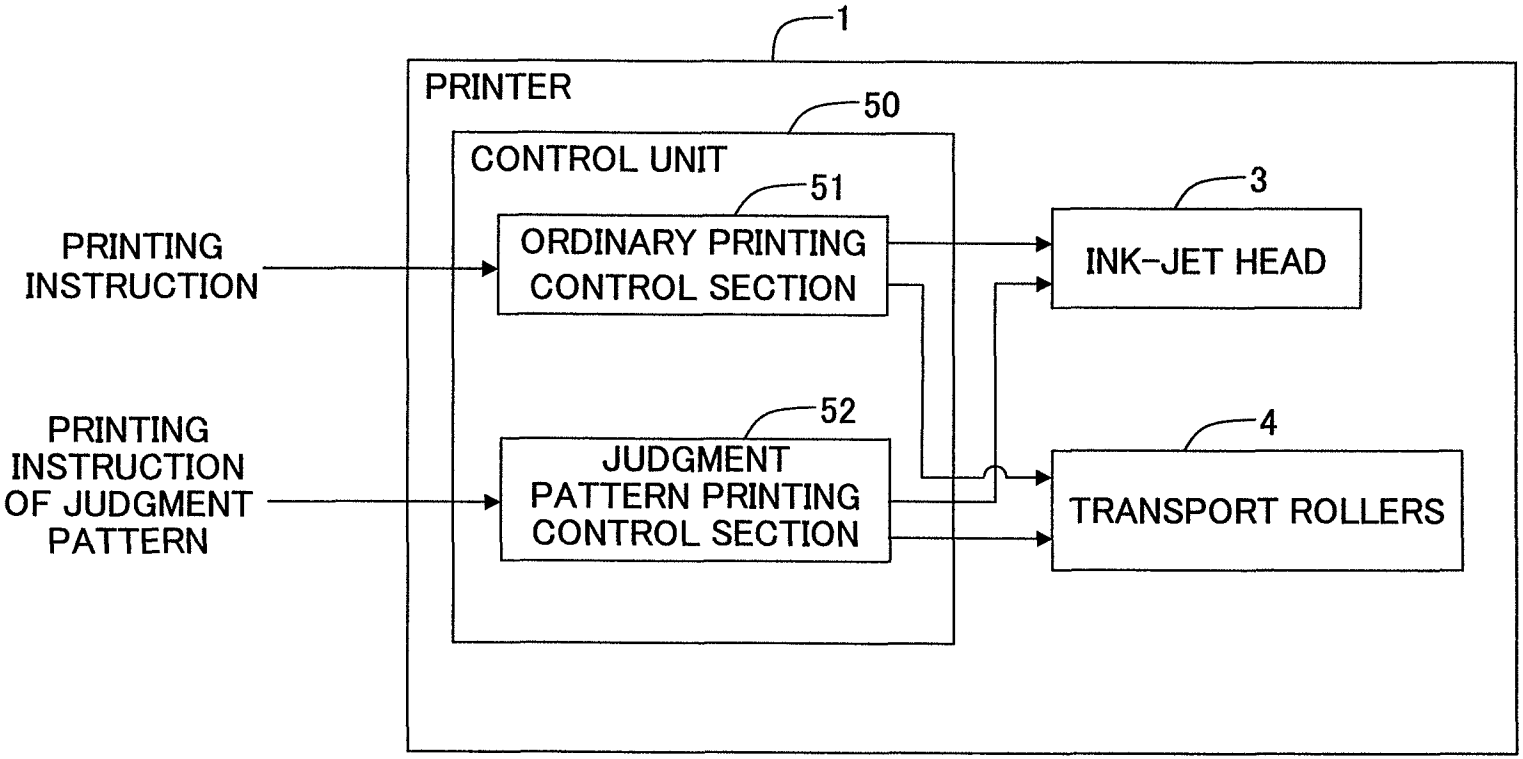
FIG. 2 shows a block diagram illustrating a control unit shown in FIG. 1.

As shown in FIG. 2, the control unit 50 includes, for example, Central Processing Unit (CPU), Read Only Memory (ROM), and Random Access Memory (RAM). As shown in FIG. 2, these components are operated, for example, as an ordinary printing control section 51 and a judgment pattern printing control section 52.

The ordinary printing control section 51 controls the ink jet head 3 and the transport rollers 4 when the ordinary printing is performed. In particular, when a signal of printing instruction, which instructs the execution of printing, is inputted from the outside of the printer 1, the printer 1 is allowed to print the image on the recording paper P by controlling the ink jet head 3 and the transport rollers 4.

The judgment pattern printing control section 52 controls the ink-jet head 3 and the transport rollers 4 when the second judgment patterns A11 to A14 and the first judgment pattern A15 are printed. In particular, when a signal of judgment pattern printing instruction, which instructs the execution of printing of the second judgment patterns A11 to A14 and the first judgment pattern A15, is inputted from the outside of the printer 1, the judgment pattern printing control section 52 allows the printer 1 to print the second judgment patterns A11 to A14 and the first judgment pattern A15 on the recording paper P by controlling the ink-jet head 3 and the transport rollers 4.

Next, an explanation will be made about the second judgment patterns A11 to A14 and the first judgment pattern A15 to be printed by performing the control by the judgment pattern printing control section 52 in the printer 1. In this embodiment, the color of the recording paper P is white.

The second judgment pattern A11 includes a plurality of straight lines L11 arranged in the paper feeding direction. The second judgment pattern A11 is printed on the portion disposed in the vicinity of the left end of the recording paper P as shown in FIG. 3. The plurality of straight lines L11 are formed by a plurality of black ink droplets landed in a state of being aligned in the scanning direction on the recording paper P. The plurality of ink droplets, which constitute each of the straight lines L11, are discharged from one nozzle 10 which constitutes the nozzle array 7*a*. The straight lines L11 correspond to the nozzles 10 for constructing the nozzle array 7*a* one-to-one.

Similarly, the second judgment patterns A12 to A14 include a plurality of straight lines L12 to L14 arranged in the paper feeding direction respectively. The second judgment patterns A12 to A14 are printed on the area disposed on the right side of the second judgment pattern A11 on the recording paper P. The plurality of straight lines L12, the plurality of straight lines L13, and the plurality of straight lines L14 are formed by a plurality of ink droplets of cyan, a plurality of ink droplets of magenta, and a plurality of ink droplets of yellow landed in a state of being aligned in the scanning direction on the recording paper P respectively.

The plurality of ink droplets for constructing each of the straight lines L12, the plurality of ink droplets for constructing each of the straight lines L13, and the plurality of ink droplets for constructing each of the straight lines L14 are discharged from one of the nozzles 10 for constructing the nozzle array 7*b*, one of the nozzles 10 for constructing the nozzle array 7*c*, and one of the nozzles 10 for constructing the nozzle array 7*b* respectively. The plurality of straight lines L12 correspond to the nozzles for constructing the nozzle array 7*b* one-to-one. Similarly, the plurality of straight lines L13 correspond to the nozzles 10 for constructing the nozzle array 7*c* one-to-one, and the plurality of straight lines L14 correspond to the nozzles 10 for constructing the nozzle array 7*d* one-to-one.

Figure 3A:
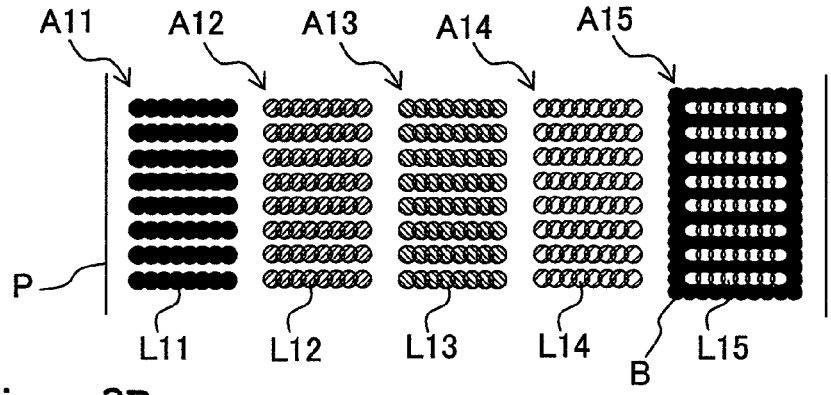

As for the second judgment patterns A11 to A14, when the ink discharge malfunction does not arise in all of the nozzles 10 for constructing the nozzle arrays 7*a* to 7*d*, all of the plurality of straight lines L11 to L14 are printed as shown in FIG. 3A.

Figure 3B:
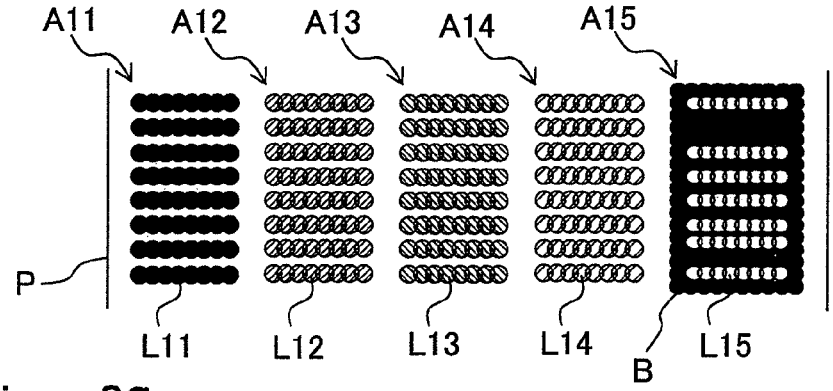
Figure 3C:
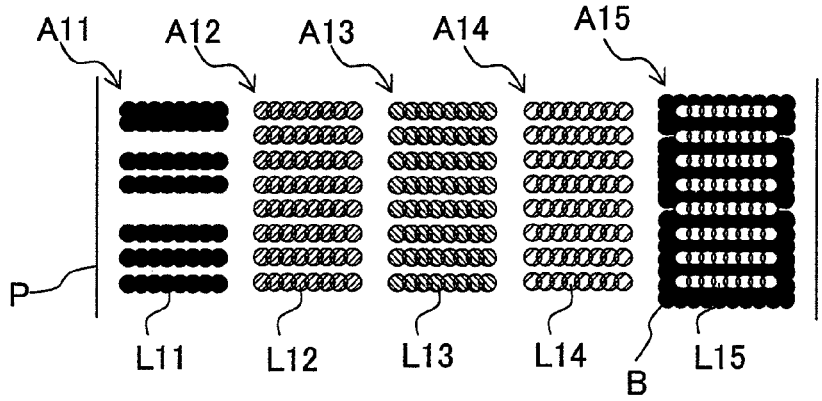
Figure 3C:
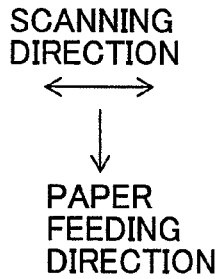

However, when the ink discharge malfunction arises in any one of the nozzles 10 for constructing the nozzle arrays 7*a* to 7*d*, as shown in FIG. 3C, the inconvenience arises, for example, such that any one of the straight lines L11 to L14 corresponding to the nozzle 10 suffered from the occurrence of the ink discharge malfunction is not printed, or that the ink droplets are landed on any position deviated from the predetermined position, for example, due to the bending of the ink discharge direction. For example, FIG. 3C shows an example in which the ink discharge failure arises in the fourth nozzle 10 as counted from the bottom for constructing the nozzle array 7*a*, and the bending of the ink discharge direction arises in the second nozzle 10 as counted from the top for constructing the nozzle array 7*a*.

In this way, it is possible to judge whether or not the ink discharge malfunction arises in the nozzle or nozzles 10 for constructing the nozzle arrays 7*a* to 7*d* by printing the second judgment patterns A11 to A14. Further, if the ink discharge malfunction arises, it is possible to judge in what nozzle 10 the ink discharge malfunction arises.

The first judgment pattern A15 includes an underlayer B and a plurality of straight lines L15 arranged in the paper feeding direction. The first judgment pattern A15 is printed on the area disposed adjacently to the right side of the second judgment pattern A14 on the recording paper P. The underlayer B is formed by a plurality of black ink droplets which are discharged from the nozzles 10 for constructing the nozzle array 7*a* and which are landed substantially without any gap on the entire area of the recording paper P on which the first judgment pattern A15 is to be printed.

The plurality of straight lines 15 are printed on an area disposed inside the outer edge portion of the underlayer B. In other words, the plurality of straight lines L15 are printed on the area of the recording paper P on which the ink droplets of the second color are landed. The plurality of straight lines L15 are formed by a plurality of white ink droplets landed in a state of being aligned in the scanning direction on the recording paper P. The plurality of ink droplets, which constitute each of the straight lines L15, are discharged from one nozzle 10 which constitutes the nozzle array 7*e* respectively. The straight lines L15 correspond to the nozzles 10 for constructing the nozzle array 7*e* one-to-one.

As for the first judgment pattern A15, if the ink discharge malfunction does not arise in all of the nozzles 10 for constructing the nozzle arrays 7*a*, 7*e*, as shown in FIG. 3A, all of the plurality of straight lines 15 are printed on the underlayer B.

However, if the ink discharge malfunction arises in any one of the nozzles 10 for constructing the nozzle array 7*e*, as shown in FIG. 3B, the inconvenience arises such that the straight line L15 corresponding to the nozzle 10 suffered from the occurrence of the ink discharge malfunction is not printed. FIG. 3B shows an example in which the discharge failure arises in the second nozzle as counted from the top of the nozzles 10 for constructing the nozzle array 7*e*. In this case, the underlayer B exposed from the portion corresponding to the landing position targeted from the nozzle suffered from the occurrence of the discharge failure.

When the bending arises in the ink discharge direction in any one of the nozzles 10 for constructing the nozzle array 7*e*, as shown in FIG. 3B, then the printing position is deviated for the straight line L15 corresponding to the nozzle 10 suffered from the occurrence of the bending of the ink discharge direction, and the underlayer B is exposed at the portion on which the straight line L15 is to be printed under normal circumstances. FIG. 3B shows an example in which the bending of the ink discharge direction arises in the second nozzle as counted from the bottom.

Therefore, it is possible to judge whether or not the ink discharge failure arises in any one of the plurality of nozzles 10 for constructing the nozzle array 7*e*, and it is possible to judge whether or not the bending arises in the ink discharge direction, depending on whether or not all of the straight lines L15 are printed and whether or not the straight lines L15 are printed at the normal positions. Further, when the ink discharge failure and/or the bending of the ink discharge direction arises, it is possible to judge in what nozzle 10 the ink discharge failure and/or the bending of the ink discharge direction arises.

It is assumed that the first judgment pattern A15 includes only the plurality of straight lines L15, and the underlayer B is not printed. In this case, the color of the plurality of straight lines L15 is approximately the same as the color of the recording paper P, and the color difference is small between the color of the straight lines L15 and the color of the recording paper P. Therefore, it is difficult to visually confirm whether or not the plurality of straight lines L15 are printed. Therefore, it is feared that it may be impossible to correctly judge whether or not the ink discharge failure arises in the nozzle 10 for constructing the nozzle array 7*e*.

However, in this embodiment, the black underlayer B, which has the large color difference from the color of the recording paper P, is printed under or below the plurality of straight lines L15. Therefore, for example, if any one of the straight lines L15 is not printed, the underlayer B is exposed to the area on which the concerning straight line L15 is to be printed. Therefore, it is possible to easily confirm whether or not the straight line L15 is printed depending on whether or not the underlayer B is exposed.

The plurality of straight lines L15 are printed on the portions disposed inside the outer edge portion of the underlayer B. Therefore, the plurality of straight lines L15 are surrounded by the outer edge portion of the underlayer B. The straight lines L15 can be confirmed more easily.

The black, which is the color of the underlayer B, has the largest color difference from the white, which is the color of the straight lines L15, among the colors of the inks other than the white (in this case, among the colors of black, cyan, magenta, and yellow). Therefore, the straight lines L15 can be confirmed more easily.

In this embodiment, as described above, when the ink discharge malfunction arises in any one of the nozzles 10 for constructing the nozzle array 7*a*, as shown in FIG. 3C, the portion, on which the black ink droplets are not landed, also appears in the corresponding area of the first judgment pattern A15.

In this situation, the ink is normally discharged from the nozzle 10 for constructing the corresponding nozzle array 7*e*, and the white ink droplets are landed in some cases on the area of the first judgment pattern A15 on which the black ink droplets are not landed. In this case, the color of the ink droplets is the same as the color of the recording paper P. Therefore, the color of the landed white ink droplets is hardly distinguished from the color of the recording paper P. Therefore, it is feared that it may be impossible or difficult to judge whether or not the ink discharge malfunction arises in the concerning nozzle 10 by observing the corresponding area of the first judgment pattern A15.

However, in this embodiment, the second judgment pattern A11 is printed together with the first judgment pattern A15 on the recording paper P. Therefore, when the user observes the area of the second judgment pattern A11 which is disposed at the same position as that of the white area of the first judgment pattern A15 in relation to the paper feeding direction, it is appreciated whether or not the black ink droplets are landed on the concerning area of the first judgment pattern A15. After the user confirms that the black ink droplets are landed on the concerning area of the first judgment pattern A15 according to the second judgment pattern A11, the user can observe the concerning area of the first judgment pattern A15. Therefore, it is possible to judge whether or not the ink discharge malfunction arises in the nozzle or nozzles 10 for discharging the white ink droplets.

Note that, the area of the first judgment pattern A15 shown in FIG. 3C, on which the black ink droplets are not landed, is white in any case when the white ink is landed and when the white ink is not landed. Therefore, it is difficult to judge whether or not the white ink droplets are landed on the area.

Next, an explanation will be made about a procedure to print the judgment patterns A11 to A15 and judge whether or not the ink discharge malfunction arises in the nozzle or nozzles 10 according to the judgment patterns A11 to A15. The following description is illustrative of an exemplary case in which the procedure described below is executed by using the control unit 50 provided for the printer 1. However, the present teaching is not limited thereto. The program for executing the procedure described below can be also executed by using a computer provided outside the printer 1.

Figure 4:
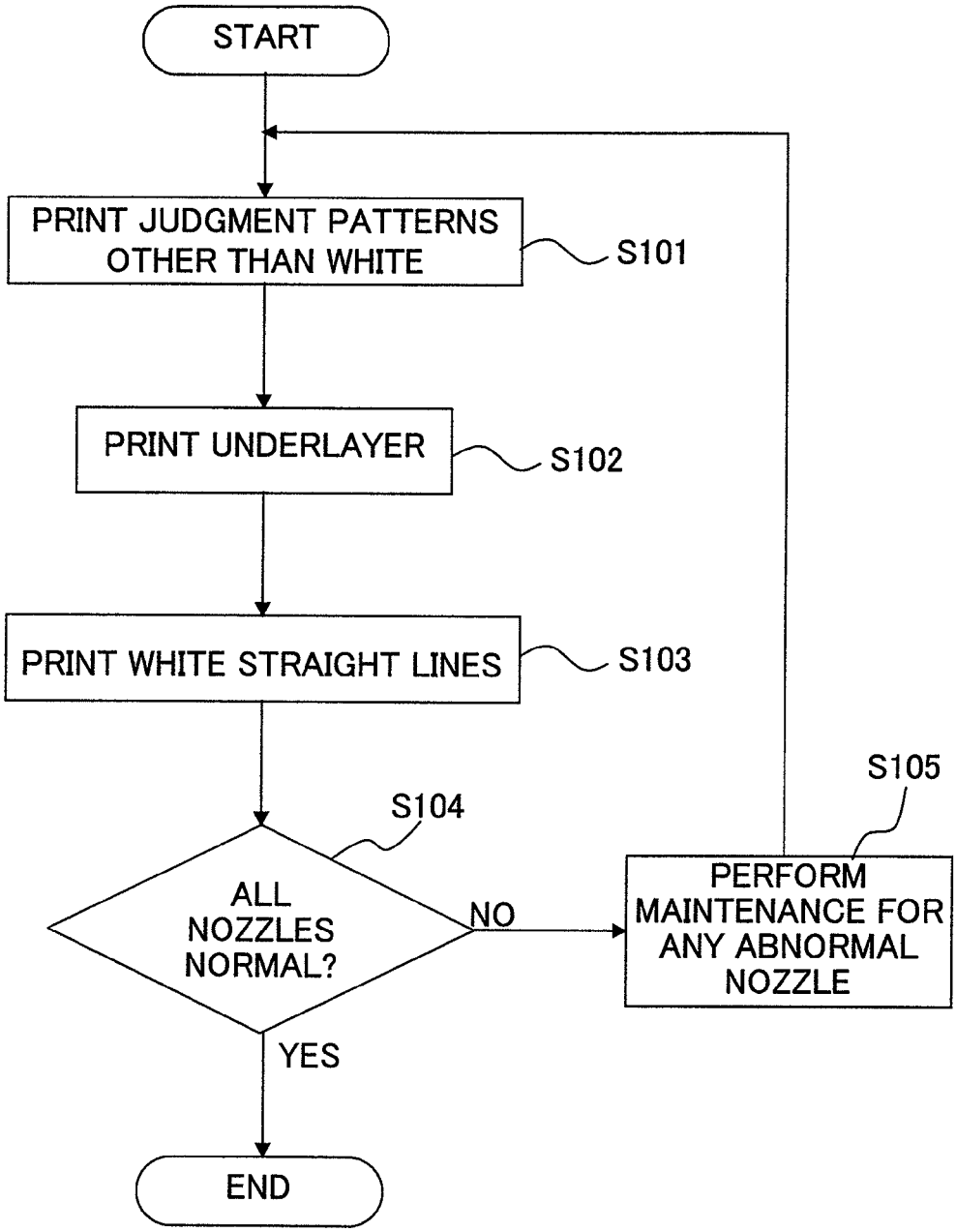
FIG. 4 shows a flow chart illustrating a procedure for printing the judgment patterns to judge the nozzle malfunction from the judgment patterns.
Figure 5A:
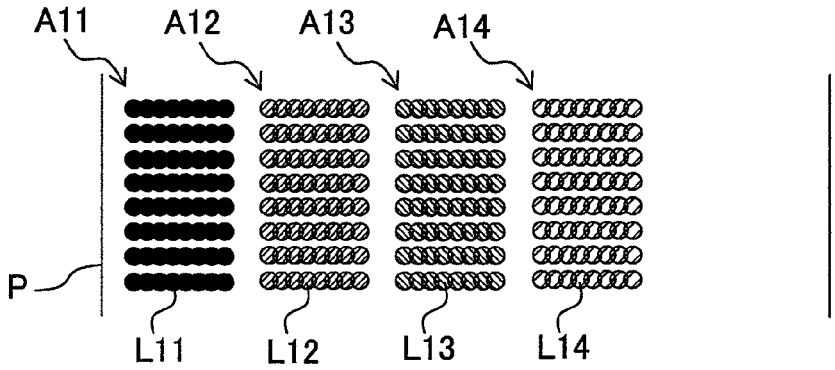
FIG. 5A shows S101 step.

When it is judged whether or not the ink discharge malfunction or abnormality arises in the nozzle or nozzles 10, the judgment pattern printing control section 52 controls the inkjet head 3 and the transport rollers 4 to print the judgment patterns A11 to A15 on the recording paper P. At first, as shown in FIG. 5A, the judgment pattern printing control section 52 allows the plurality of nozzles 10 for constructing the nozzle arrays 7*a* to 7*d* to discharge the inks therefrom toward the areas of the recording paper P on which the second judgment patterns A11 to A14 are to be printed so that the plurality of ink droplets of black, cyan, magenta, and yellow are landed on the concerning areas respectively. Accordingly, the judgment pattern printing control section 52 prints the plurality of straight lines L11 to L14, i.e., the second judgment patterns A11 to A14 (Step S101 shown in FIG. 4, hereinafter simply referred to, for example, as "S101").

Figure 5B:
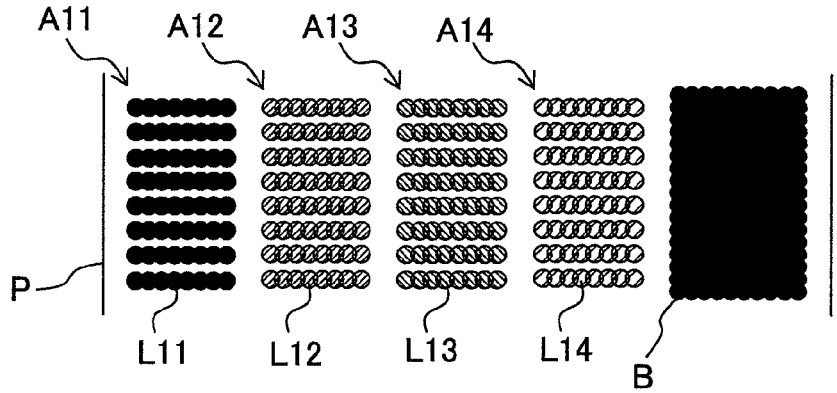
FIG. 5B shows S102 step.

Subsequently, the judgment pattern printing control section 52 allows the plurality of nozzles 10 for constructing the nozzle array 7*a* to discharge the ink therefrom toward the area on which the first judgment pattern A15 is to be printed on the recording paper P so that the plurality of black ink droplets are landed on the entire region of the concerning area. Accordingly, as shown in FIG. 5B, the underlayer B is printed (S102). In this process, the recording paper P may be fed reversely to the position under the ink-jet head 3 without discharging the recording paper P after executing S101 described above, and S102 described above may be executed for the same recording paper P. Alternatively, the recording paper P may be discharged after executing S101 described above, and the discharged recording paper P may be fed again to execute S102 described above. Note that any one of S101 and S102 described above may be performed previously.

Figure 5C:
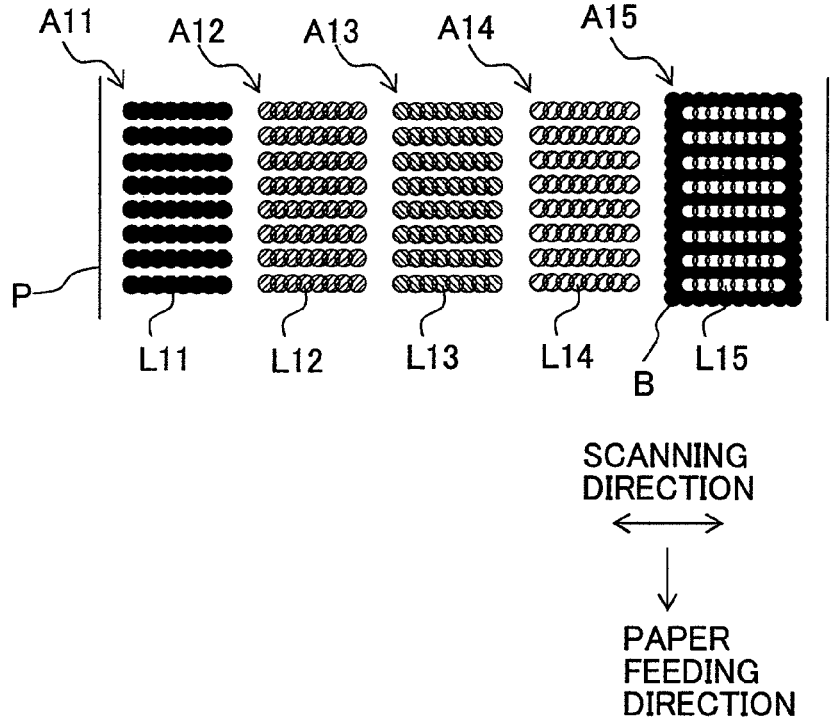
FIG. 5C shows S103 step, as shown in FIG. 4.

Subsequently, the judgment pattern printing control section 52 allows the plurality of nozzles 10 for constructing the nozzle array 7*e* to discharge the ink therefrom toward the underlayer B so that the plurality of white ink droplets are landed on the underlayer B. Accordingly, as shown in FIG. 5C, the plurality of straight lines L15 are printed on the underlayer B (S103). In this way, the first judgment pattern A15 is printed by printing the underlayer B and the plurality of straight lines L15.

Subsequently, the user judges whether or not the ink discharge malfunction arises in the nozzle or nozzles 10 according to the printed judgment patterns A11 to A15 (S104).

Specifically, if all of the plurality of straight lines L11 to L14 are printed on the printed second judgment patterns A11 to A14, and they are printed at the predetermined positions, then it is judged that the ink discharge malfunction does not arise in the nozzles 10 for constructing the nozzle arrays 7*a* to 7*d*. If any one of the plurality of straight lines L11 to L14 is not printed, or any one of the printing positions of the plurality of straight lines L11 to L14 is deviated from the predetermined position, then it is judged that the ink discharge malfunction arises in the nozzle or nozzles 10 corresponding to the concerning straight line or straight lines.

Further, when all of the straight lines L15 are printed on the first judgment pattern A15, and when the underlayer B is not exposed to the areas on which all of the straight lines L15 are to be printed, then it is judged that the ink discharge malfunction does not arise in the nozzles 10 for constructing the nozzle array 7*e*. When any one of the straight lines 15 is not printed, or when the ink droplets are landed while being deviated from the predetermined position, the underlayer B is exposed to any area on which the straight line L15 is to be printed. Therefore, when the second color is detected, it is judged that the ink discharge malfunction arises in the nozzle or nozzles 10 corresponding to the concerning straight line or straight lines L15.

When it is judged that the ink discharge malfunction arises in any one of the nozzles 10 (S104: NO), then the maintenance, which includes, for example, the flashing and the purge, is performed for the concerning nozzle 10 (S105), and the routine returns to S101. On the other hand, when it is judged that the ink discharge malfunction does not arise in all of the nozzles 10 (S104: YES), the operation is completed.

According to the embodiment described above, it is possible to judge whether or not the ink discharge malfunction arises in any one of the plurality of nozzles 10 for constructing the nozzle array 7*e*, according to the first judgment pattern A15. Further, it is possible to specify in what nozzle 10 the ink discharge malfunction arises.

Further, the underlayer B, which has the color different from the color of the recording paper P, is printed on the area on which the straight lines L15 are to be printed. Therefore, it is possible to easily judge the printing state of the straight lines L15.

The underlayer B is also printed on the area of the recording paper P to surround the area on which the plurality of straight lines L15 are to be printed. Therefore, it is easy to confirm the straight lines L15.

Further, the black, which is the color of the underlayer B, is the color which has the largest color difference from the white as the color of the straight lines L15, of the colors of the inks other than the white (black, cyan, magenta, and yellow). Therefore, it is easy to confirm the straight lines L15.

The second judgment pattern A11 is printed together with the first judgment pattern A15 on the recording paper P. When the user observes the white area of the first judgment pattern A15 and the area of the second judgment pattern A11 which is disposed at the same position in relation to the paper feeding direction, it is appreciated whether or not the black ink droplets are landed on the concerning area of the first judgment pattern A15. When the concerning area of the first judgment pattern A15 is confirmed after confirming the fact that the black ink droplets are landed on the concerning area of the first judgment pattern A15 according to the second judgment pattern A11, it is possible to judge whether or not the ink discharge malfunction arises in the nozzle or nozzles 10 for discharging the white ink droplets.

Next, an explanation will be made about modified embodiments in which various modifications are applied to the embodiment of the present teaching. However, those constructed in the same manner as those of the embodiment of the present invention are designated by the same reference numerals, any explanation of which will be appropriately omitted.

First Modified Embodiment

Figure 6A:
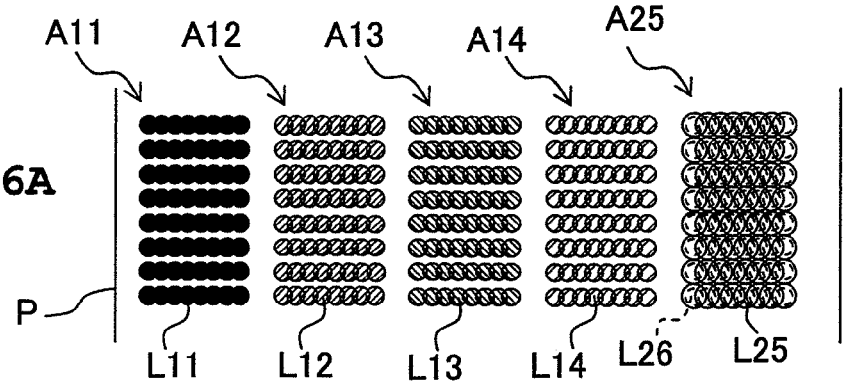
FIGS. 6A, 6B and 6C show judgment patterns of a first modified embodiment corresponding to FIGS. 3A to 3C, respectively.

As shown in FIG. 6A, the judgment pattern printing control section 52 (see FIG. 2) controls, for example, the ink-jet head 3 to print, on the recording paper P, the second judgment patterns A11 to A14 which are the same as or equivalent to those of the embodiment described above as the second judgment patterns, and print another first judgment pattern A25 in place of the first judgment pattern A15.

The first judgment pattern A25 includes a plurality of straight lines L26 and a plurality of straight lines L25. The plurality of straight lines L26 are the black straight lines which are the same as or equivalent to the plurality of straight lines L11 for constructing the second judgment pattern A11. The plurality of straight lines L25 are the white straight lines which are arranged and overlapped with the black straight lines L26. The plurality of straight lines L25 are formed by aligning, in the scanning direction, a plurality of white ink droplets which are landed on the same positions as the positions of the landing of the plurality of black ink droplets for constructing the plurality of straight lines L26 and which have volumes larger than those of the black ink droplets. The plurality of ink droplets for constructing each of the straight lines L25 are discharged from one nozzle 10 for constructing the nozzle array 7*e* respectively. The straight lines L25 correspond to the nozzles 10 for constructing the nozzle array 7*e* one-to-one.

When the ink discharge malfunction does not arise in any one of the nozzles 10 for constructing the nozzle array 7*a* for discharging the black ink and the nozzles 10 for constructing the nozzle array 7*e* for discharging the white ink, as shown in FIG. 6A, all of the plurality of straight lines L26 are covered with the plurality of straight lines L25. Therefore, the plurality of straight lines L26 are not exposed.

Figure 6B:
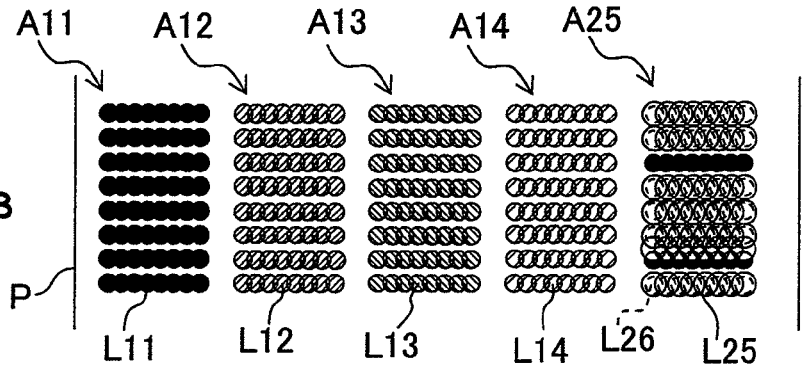

However, when the ink discharge malfunction arises in any one of the nozzles 10 for constructing the nozzle array 7*e* for discharging the white ink, as shown in FIG. 6B, the straight line L26, which corresponds to the straight line L25 corresponding to the nozzle 10 suffered from the occurrence of the ink discharge malfunction, is exposed. FIG. 6B shows an example in which the ink discharge failure arises in the third nozzle 10 as counted from the top for constructing the nozzle array 7*e*, and the bending of the ink discharge direction arises in the second nozzle 10 as counted from the bottom for constructing the nozzle array 7*e*. Accordingly, it is easy to judge whether or not the ink discharge malfunction arises in the nozzle or nozzles 10 for constructing the nozzle array 7*e* for discharging the white ink.

Figure 6C:
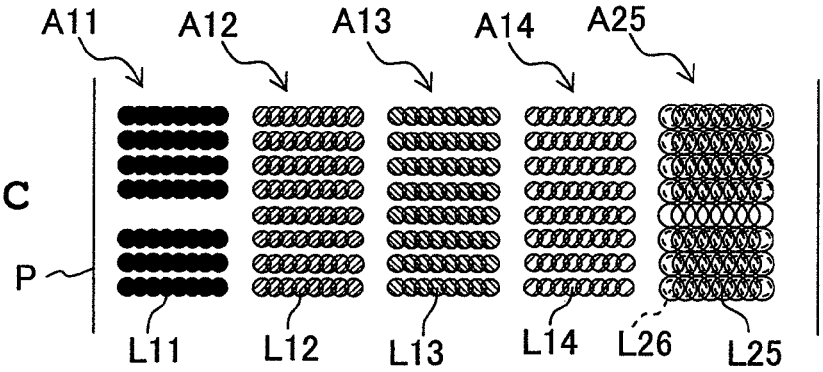
Figure 6C:
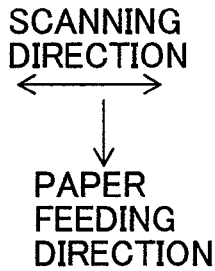

In the first modified embodiment, when the ink discharge failure arises in any one of the nozzles 10 for constructing the nozzle array 7*a* for discharging the black ink, as shown in FIG. 6C, the straight line L26 of the judgment pattern A25, which corresponds to the nozzle 10 suffered from the occurrence of the ink discharge failure, is not printed.

In this situation, in relation to the area of the judgment pattern A25 on which the straight line L26 is not printed, it is feared that it cannot be judged whether or not the ink discharge malfunction arises in the concerning nozzle 10 by observing the area of the judgment pattern A25, even when the ink is normally discharged from the nozzle 10 for constructing the corresponding nozzle array 7*e* to land the white ink droplets in the same manner as in the embodiment described above, because the color of the ink droplets is the same as the color of the recording paper P.

However, in the first modified embodiment as well, the judgment pattern A11 is printed together with the judgment pattern A25. When the area of the judgment pattern A11, which is disposed at the same position as that of the white area of the judgment pattern A25 in relation to the paper feeding direction (upward-downward direction as viewed in FIG. 6), is observed, it is appreciated whether or not the straight line L26 is printed on the concerning area of the judgment pattern A25. When the user observes the concerning area of the first judgment pattern A11 after confirming that the black straight line L26 is printed on the concerning area of the first judgment pattern A25, according to the second judgment pattern A11, it is possible to judge whether or not the ink discharge malfunction arises in the nozzle 10 for discharging the white ink droplets.

Figure 7:
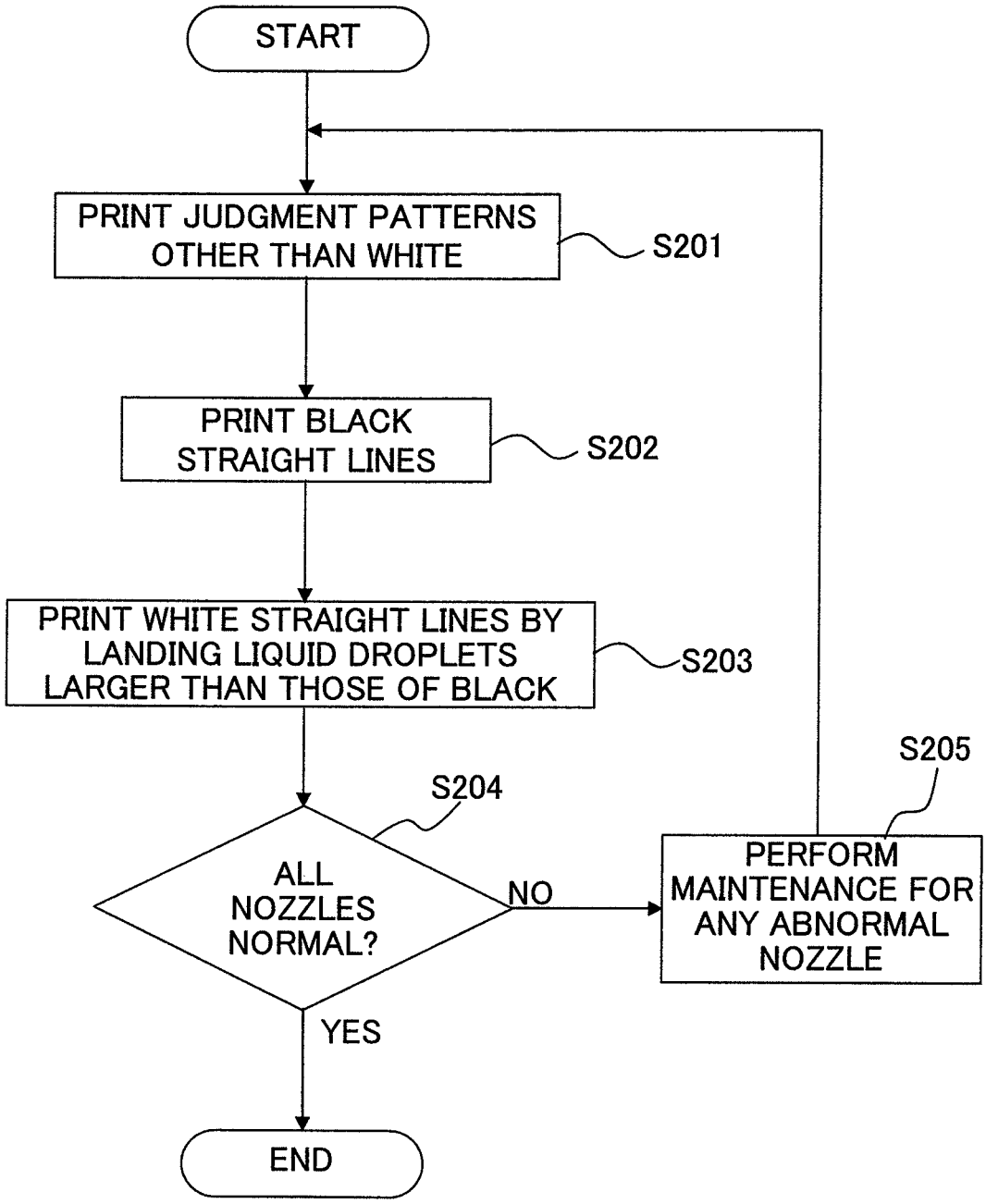
FIG. 7 shows a flow chart corresponding to FIG. 4 in the first modified embodiment.
Figure 8A:
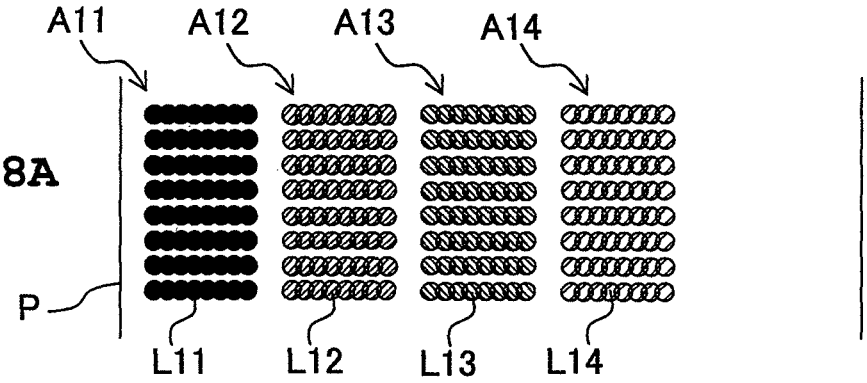
FIG. 8A shows S201 step.
Figure 8B:
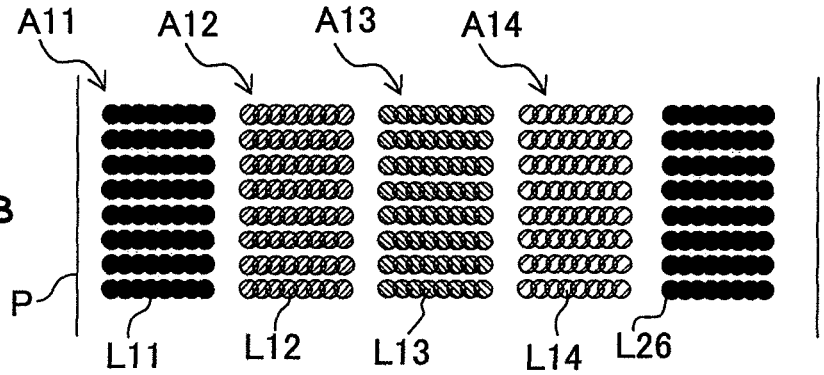
FIG. 8B shows S202 step.

When the judgment patterns A11 to A14 and A25 are printed as described above to judge whether or not the ink discharge malfunction arises in the nozzle or nozzles 10 according to the judgment patterns A11 to A14 and A25, the judgment pattern printing control section 52 firstly controls the ink-jet head 3 and the transport rollers 4 to print the judgment patterns A11 to A14 in the same manner as in the embodiment described above as shown in FIGS. 7 and 8A (S201). Further, the inks are discharged from the nozzles 10 for constructing the nozzle array 7*a* toward the area of the recording paper P on which the judgment pattern A25 is to be printed so that the black ink droplets are landed on the concerning area. Accordingly, as shown in FIG. 8B, the plurality of straight lines L26 are printed (S202).

Figure 8C:
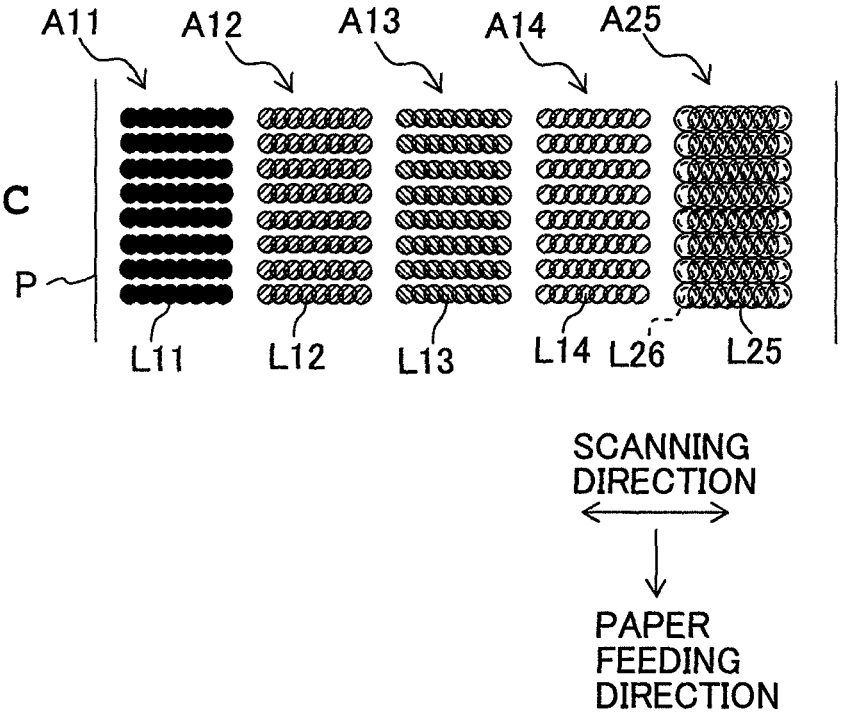
FIG. 8C shows S203 step, as shown in FIG. 7.

Subsequently, the judgment pattern printing control section 52 allows the nozzles 10 for constructing the nozzle array 7*e* to discharge the ink therefrom to the same positions as the positions of the landing of the black ink droplets for constructing the straight lines L26 on the recording paper P so that the white ink droplets, which have the volumes larger than those of the black ink droplets, are landed on the concerning positions. In this way, as shown in FIG. 8C, the plurality of white straight lines L25, which cover the plurality of black straight lines L26, are printed (S203).

In this process, the white ink droplets, which constitute the plurality of straight lines L25, have the volumes larger than the volumes of the black ink droplets which constitute the plurality of straight lines L26. Therefore, even when there is any slight deviation in relation to the ink discharge direction in the nozzles 10 for constructing the nozzle array 7*a* or the nozzle array 7*e*, the plurality of straight lines L26 are reliably covered with the plurality of straight lines L25. Thus, the first judgment pattern A25 is printed by printing the plurality of straight lines L25, L26 as described above.

Subsequently, the user judges whether or not the ink discharge malfunction arises in the nozzle or nozzles 10 from the printed second judgment patterns A11 to A14 and the printed first judgment pattern A25 (S204).

Specifically, it is judged whether or not the ink discharge malfunction arises in the nozzle or nozzles 10 for constructing the nozzle arrays 7*a* to 7*d* from the printed second judgment patterns A11 to A14 in the same manner as in the embodiment described above. When all of the straight lines L25 are printed in the first judgment pattern A25, none of the straight lines L26 are exposed. Then it is judged that the ink discharge malfunction does not arise in the nozzles 10 for constructing the nozzle array 7*e*. When any one of the straight lines L25 is not printed, the straight line L26 is exposed in the area on which the concerning straight line L25 is to be printed. Therefore, when the second color is detected, it is judged that the ink discharge malfunction arises in the nozzle 10 corresponding to the concerning straight line L25.

When it is judged that the ink discharge malfunction arises in any one of the nozzles 10 (S204: NO), the maintenance is performed for the nozzle 10 (S205) in the same manner as in the embodiment described above, and the routine returns to S201. On the other hand, when it is judged that the ink discharge malfunction does not arise in all of the nozzles 10 (S204: YES), the operation is completed.

Second Modified Embodiment

Figure 9A:
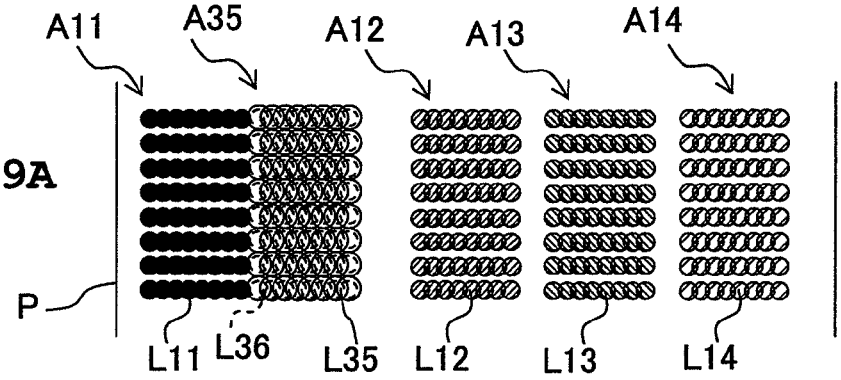
FIGS. 9A, 9B and 9C show judgment patterns of a second modified embodiment corresponding to FIGS. 3A to 3C, respectively.

As shown in FIG. 9A, the judgment pattern printing control section 52 controls, for example, the ink-jet head 3 to print a first judgment pattern A35 adjacently to the right side of the second judgment pattern A11 and print the second judgment patterns A12 to A14 on the right side of the first judgment pattern A35 respectively.

The first judgment pattern A35 includes a plurality of black straight lines L36 and a plurality of white straight lines L35. The plurality of straight lines L36 are the straight lines which extend in the scanning direction from the right ends of the plurality of straight lines L11 and which are integrated with the plurality of straight lines L11. The plurality of straight lines L36 are formed such that the plurality of ink droplets, which are discharged from the nozzles 10 for constructing the nozzle array 7*a*, are landed in a state of being aligned in the scanning direction. The other components are constructed in the same manner as in the first modified embodiment.

Figure 9B:
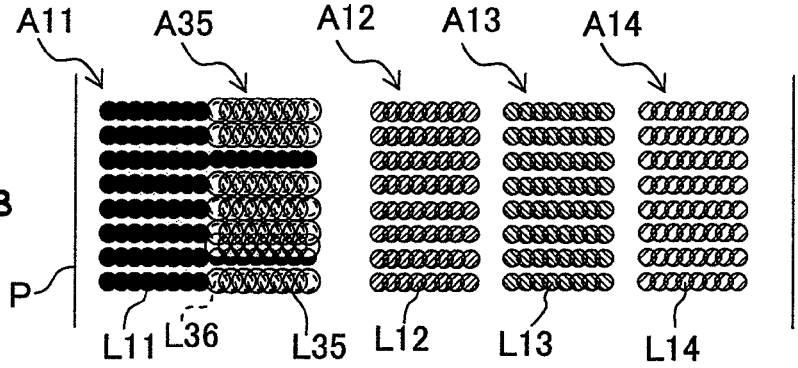

According to this arrangement, the second judgment pattern A11 and the first judgment pattern A35 are disposed adjacently to one another. The plurality of straight lines L11, which constitute the second judgment pattern A11, are integrated with the plurality of straight lines L36 which constitute the second judgment pattern A35. Therefore, as shown in FIG. 9B, it is easy to confirm whether or not the straight lines 36 are printed on the area of the first judgment pattern A35.

Figure 9C:
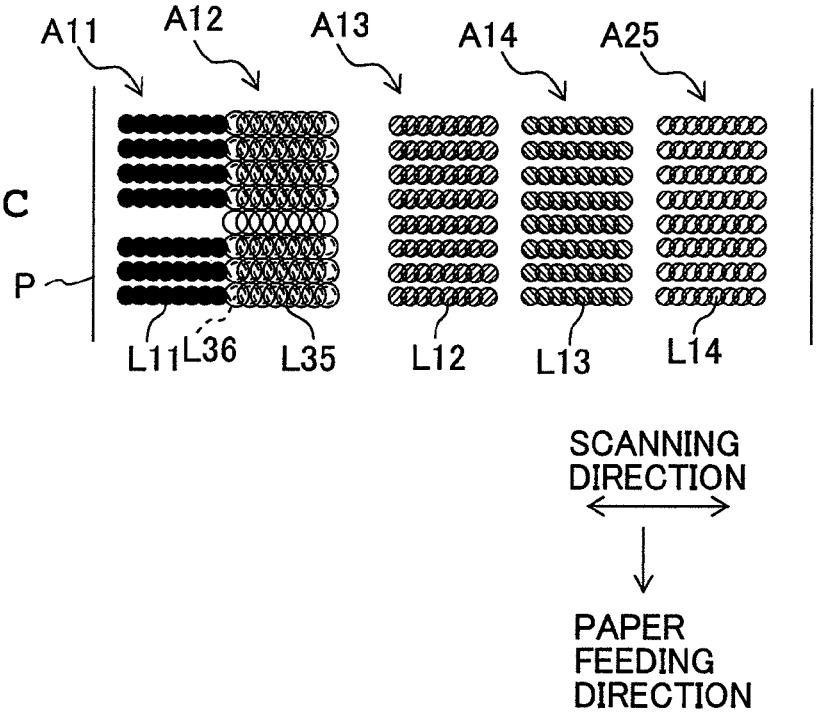

However, the area of the first judgment pattern A35 shown in FIG. 9C, on which the straight line L36 is not printed, is white in any case when the white straight line L35 is printed and when the straight line L35 is not printed. Therefore, it is difficult to judge whether or not the straight line L35 is printed on this area, i.e., whether or not the ink discharge malfunction arises in the nozzle 10 corresponding to the concerning straight line L35.

Third Modified Embodiment

Figure 10A:
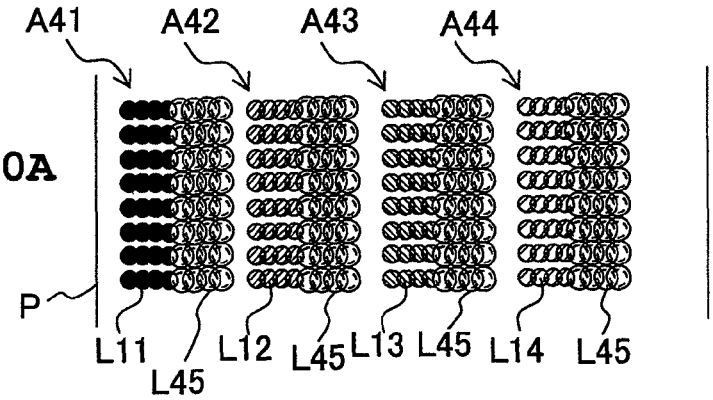
FIG. 10A, 10B and 10C show judgment patterns of a third modified embodiment corresponding to FIGS. 3A to 3C, respectively.

As shown in FIG. 10A, the judgment pattern printing control section 52 controls, for example, the ink-jet head 3 to print judgment patterns A41 to A44 in place of the judgment patterns A11 to A15 on the recording paper P. The third modified embodiment is different from the second modified embodiment in that the white corresponds to the first color according to the present teaching, and all of the colors except for the white (the black, the cyan, and the magenta) correspond to the second color according to the present teaching.

The judgment patterns A41 to A44 include the plurality of straight lines L11 to L14 which are the same as or equivalent to those of the judgment patterns A11 to A14, and a plurality of white straight lines L45 respectively. The plurality of straight lines L45 are formed by aligning, in the scanning direction, a plurality of white ink droplets which are landed respectively on the same positions as the positions of the landing of the ink droplets for constructing approximate right halves of the plurality of straight lines L11 to L14 and which have volumes larger than those of these ink droplets. In the third modified embodiment, the approximate right halves of the judgment patterns A41 to A44 correspond to the first judgment pattern according to the present teaching, and the approximate left halves correspond to the second judgment pattern according to the present teaching.

When the ink discharge malfunction does not arises in any one of the nozzles 10 for constructing the nozzle arrays 7*a* to 7*d* for discharging the inks other than the white and the nozzles 10 for constructing the nozzle array 7*e* for discharging the white ink, as shown in FIG. 10A, then all of the plurality of straight lines L11 to L14 are printed, and all of the approximate right halves of the plurality of straight lines L11 to L14 are covered with the plurality of straight lines L45. Therefore, the approximate right halves of the plurality of straight lines L11 to L14 are not exposed.

Figure 10B:
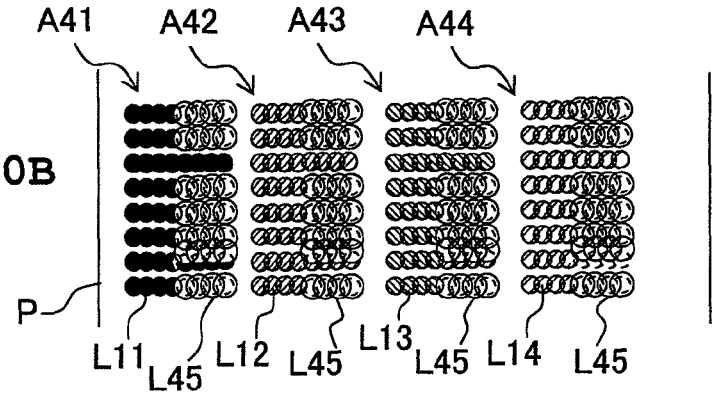

However, when the ink discharge malfunction arises in any one of the nozzles 10 for constructing the nozzle array 7*e* for discharging the white ink, as shown in FIG. 10B, then the straight lines L45, which correspond to the nozzle 10 suffered from the occurrence of the ink discharge malfunction, are not printed, and the approximate right halves of the straight lines L11 to L14 corresponding to the straight lines L45 are exposed. FIG. 10B shows an example in which the discharge failure arises in the third nozzle as counted from the top of the nozzles 10 for constructing the nozzle array 7*e*, and the bending of the ink discharge arises in the second nozzle as counted from the bottom.

Therefore, it is possible to easily judge whether or not the ink discharge malfunction arises in the nozzle or nozzles 10 for constructing the nozzle array 7*e* for discharging the white ink depending on whether or not the straight lines L11 to L14 are exposed at the approximate right halves of the areas of the recording paper P on which the judgment patterns A41 to A44 are to be printed.

Figure 10C:
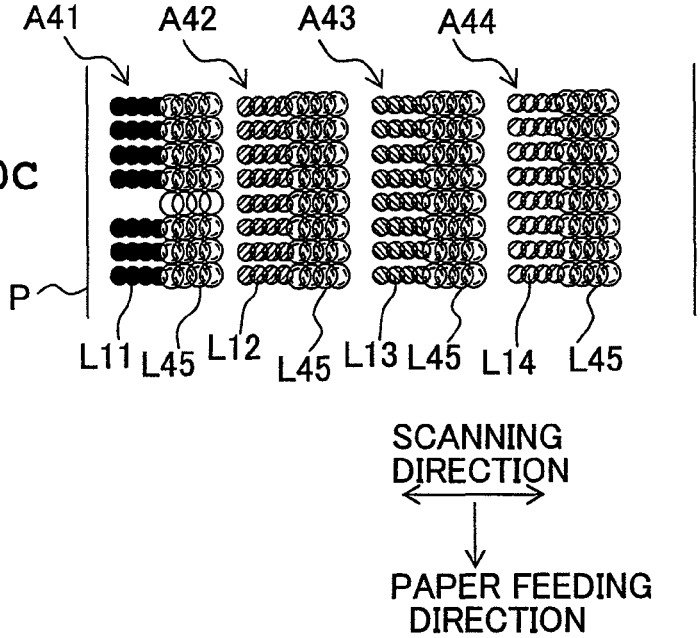

In this modified embodiment, as shown in FIG. 10C, even when the discharge malfunction arises in any one of the nozzles 10 for constructing the nozzle arrays 7*a* to 7*d*, it is possible to easily judge whether or not the ink discharge malfunction arises in the nozzle or nozzles 10 for constructing the nozzle array 7*e* for discharging the white ink, provided that the ink discharge malfunction does not arise in all of the nozzles 10 which are disposed at the same positions in relation to the paper feeding direction. If the ink discharge malfunction is not caused in the nozzles 10 for constructing the nozzle array 7*e*, the judgment patterns A41 to A44 are in the state as shown in FIG. 10A. In other words, the right sides of the judgment patterns A41 to A44, which correspond to the nozzles 10 suffered from no occurrence of the discharge malfunction, are covered with the white ink, and the straight lines L11 to L14 are not exposed. On the contrary, when the ink discharge malfunction arises in the nozzle or nozzles 10 for constructing the nozzle array 7*e*, the state as shown in FIG. 10B is given. In other words, the straight lines L11 to L14 are exposed on the right sides of all of the judgment patterns A41 to A44 corresponding to the nozzles 10 suffered from the occurrence of the discharge malfunction. In this way, it is possible to judge whether or not the ink discharge malfunction arises in all of the nozzles 10.

In the embodiment described above and the first, second, and third modified embodiments, the second judgment pattern (approximate left halves of the judgment patterns A11, A41 to A44), which indicates whether or not the ink discharge malfunction arises in the nozzle or nozzles 10 for discharging the inks other than the white, is printed together with the first judgment pattern (approximate right halves of the judgment patterns A15, A25, A35, A41 to A44) which indicates whether or not the ink discharge malfunction arises in the nozzle or nozzles 10 for discharging the white ink, and it is judged whether or not the ink discharge malfunction arises in all of the nozzles 10. However, only the first judgment pattern (approximate right halves of the judgment patterns A15, A25, A35, A41 to A44) may be printed to judge whether or not the ink discharge malfunction arises in relation to only the nozzles 10 for discharging the white ink.

In the foregoing description, it is judged whether or not the ink discharge malfunction arises in the nozzle or nozzles 10 after printing both of the first judgment pattern to indicate whether or not the ink discharge malfunction arises in the nozzle or nozzles 10 for discharging the white ink and the second judgment pattern to indicate whether or not the ink discharge malfunction arises in the nozzle or nozzles 10 for discharging the inks other than the white. However, the present teaching is not limited thereto. That is, at first, the second judgment pattern may be printed to judge whether or not the ink discharge malfunction arises in the nozzle or nozzles 10 for discharging the inks other than the white. After that, the recording paper P, on which the concerning second judgment pattern has been printed, may be supplied to the printer 1 again. The first judgment pattern may be printed on the concerning recording paper P to judge whether or not the ink discharge malfunction arises in the nozzle or nozzles 10 for discharging the white ink.

Fourth Modified Embodiment

Figure 11:
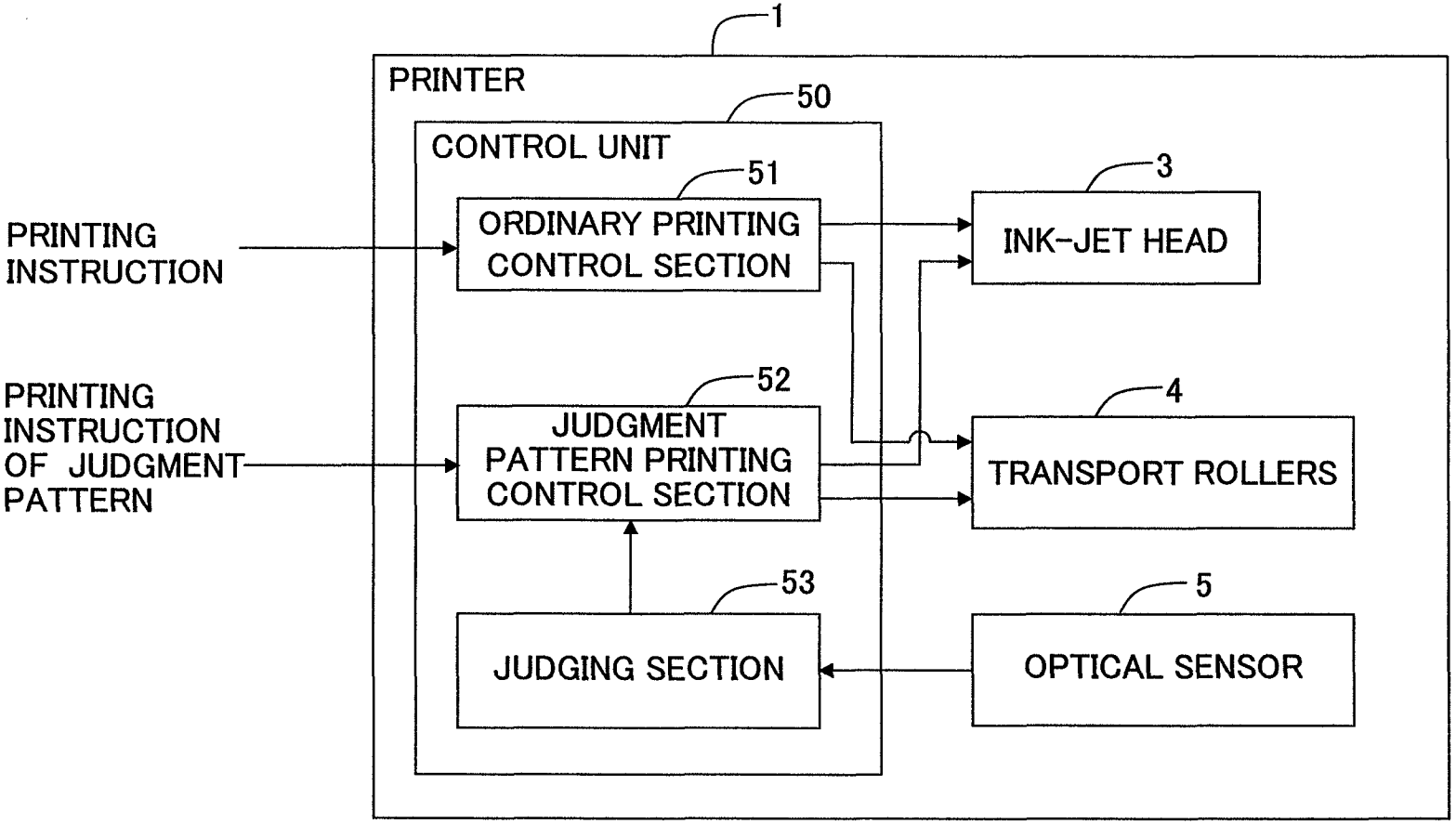
FIG. 11 shows a block diagram corresponding to FIG. 2 in a fourth embodiment.

As shown in FIG. 11, the printer 1 further includes an optical sensor 5 (color detector, color sensor) which is capable of detecting the colors. The control unit 50 further includes a judging section 53 which judges whether or not the ink discharge malfunction arises in the nozzle or nozzles 10 according to a detection result obtained by the optical sensor 5. Those usable as the optical sensor 5 include, for example, a contact image sensor (CIS) and CCD.

Figure 12:
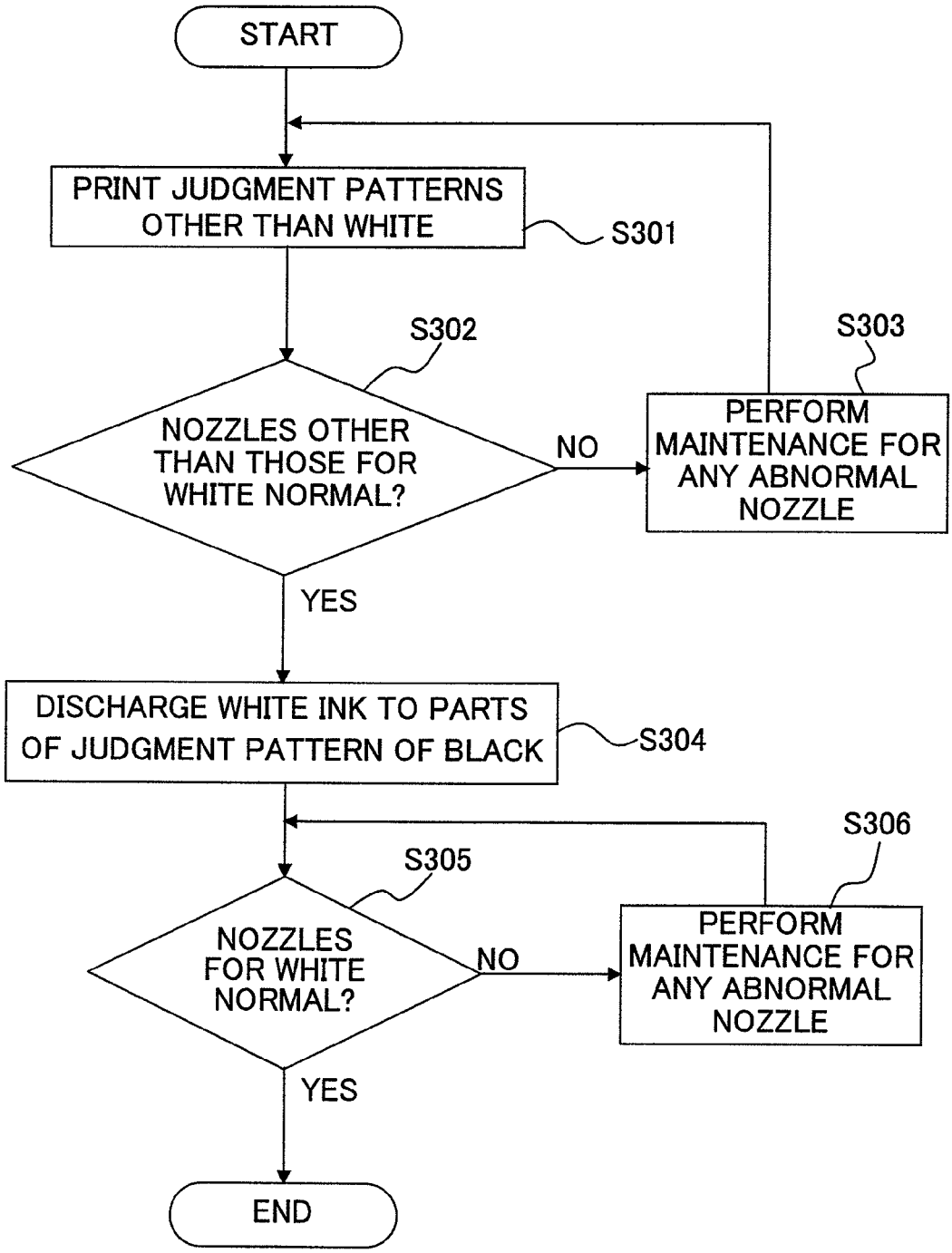
FIG. 12 shows a flow chart corresponding to FIG. 4 in the fourth modified embodiment.
Figure 13A:
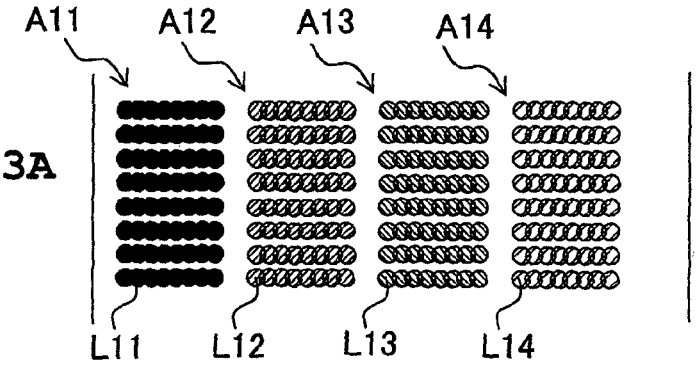
FIG. 13A shows S301 step.

In the fourth modified embodiment, when the judgment patterns are printed to judge whether or not the ink discharge malfunction arises in the nozzle or nozzles 10 according to the judgment patterns, the judgment pattern printing control section 52 firstly controls the ink-jet head 3 and the transport rollers 4 to print the second judgment patterns A11 to A14 (S301) in the same manner as in the embodiment described above as shown in FIGS. 12 and 13A. In the fourth modified embodiment, the procedure of S301 includes both of the second judgment pattern printing procedure according to the present teaching and the second ink discharge procedure.

Subsequently, the judging section 53 judges whether or not the ink discharge malfunction arises in the nozzle or nozzles 10 for constructing the nozzle arrays 7*a* to 7*d* (S302). Specifically, if the optical sensor 5 does not detect the white as the color of the recording paper P in the areas on which all of the straight lines L11 to L14 are to be printed, it is judged that the ink discharge malfunction does not arise in the nozzles 10 for constructing the nozzle arrays 7*a* to 7*d*. If the optical sensor 5 detects the white as the color of the recording paper P in any one of the areas on which the straight lines L11 to L14 are to be printed, it is judged that the ink discharge malfunction arises in the nozzle or nozzles 10 corresponding to the concerning straight line or straight lines (second judging step).

Alternatively, when the optical sensor 5 detects the colors of the straight lines L11 to L14 (black, cyan, magenta, and yellow) in the areas on which all of the straight lines L11 to L14 are to be printed, it may be judged that the ink discharge malfunction does not arise in the nozzles 10 for constructing the nozzle arrays 7*a* to 7*d*. When the optical sensor 5 does not detect the color or colors of the straight lines L11 to L14 in any one of the areas on which the straight lines L11 to L14 are to be printed, it may be judged that the ink discharge malfunction arises in the nozzle or nozzles 10 corresponding to the straight line or straight lines not detected.

When it is judged that the ink discharge malfunction arises in any one of the nozzles 10 for constructing the nozzle arrays 7*a* to 7*d* (S302: NO), the maintenance, which includes, for example, the flashing and the purge, is performed for the concerning nozzle 10 (S303), and the routine returns to S301 described above.

Figure 13B:
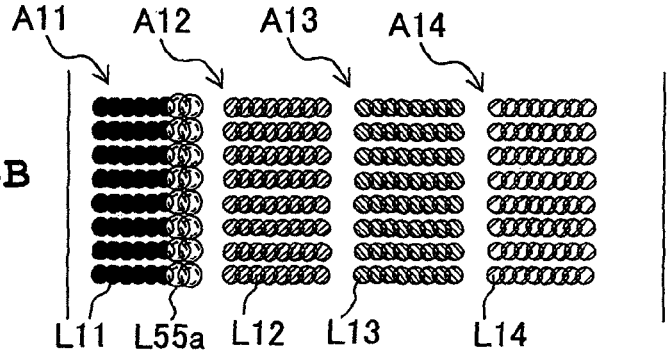
FIG. 13B shows S304 step in which no ink discharge malfunction arises in nozzles for discharging the white ink.

On the other hand, when it is judged that the ink discharge malfunction does not arise in all of the nozzles 10 for constructing the nozzle arrays 7*a* to 7*d* (S302: YES), the judgment pattern printing control section 52 allows the nozzles 10 for constructing the nozzle array 7*e* to discharge the white ink therefrom to the areas opposed to the right end portions of the plurality of straight lines L11 for constructing the second judgment pattern A11 on the recording paper P printed with the second judgment patterns A11 to A14 to thereby print the plurality of straight lines L55*a* as shown in FIG. 13B (S304: first ink discharge procedure). In this process, the straight lines L55*a* are formed such that the white ink droplets, which have the volumes larger than those of the ink droplets for constructing the straight lines L11, are landed while being aligned in the scanning direction.

In this case, the right end portions of the plurality of straight lines L11 and the plurality of straight lines L55*a* correspond to the first judgment pattern according to the present teaching. The procedure of S301 described above to function as the second ink discharge procedure as well and the procedure of S304 correspond to the first judgment pattern printing procedure according to the present teaching.

Figure 13C:
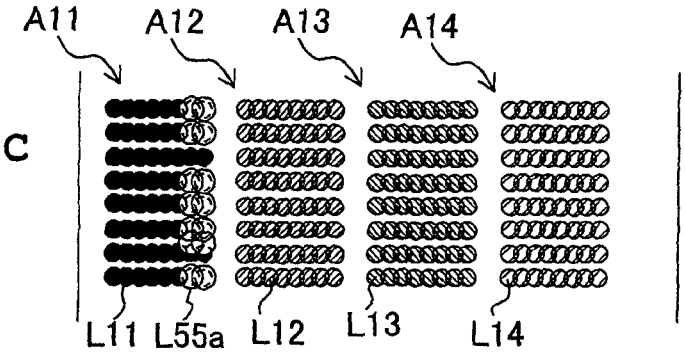
FIG. 13C shows S304 step in which the ink discharge malfunction arises in nozzles for discharging the white ink.

In this process, when the ink discharge malfunction does not arise in all of the nozzles 10 for constructing the nozzle array 7*e*, as shown in FIG. 13B, all of the right end portions of the plurality of straight lines L11 are white by being covered with the plurality of straight lines L55*a*. When the ink discharge malfunction arises in any one of the nozzles 10 for constructing the nozzle array 7*e*, as shown in FIG. 13C, then any one of the straight lines L55*a* is not printed, and any one of the right end portions of the straight lines L11 is exposed.

Subsequently, the judging section 53 judges whether or not the ink discharge malfunction arises in the nozzle or nozzles 10 for constructing the nozzle array 7*e* (S305, first judgment procedure).

Specifically, when the optical sensor 5 does not detect the black in the area on which the straight lines L55*a* are to be printed, it is judged that the ink discharge malfunction does not arise in the nozzles 10 for constructing the nozzle array 7*e*. When the optical sensor 5 detects the black, it is judged that the ink discharge malfunction arises in the nozzle or nozzles 10 corresponding to the straight line or straight lines L55*a* to be printed on the area in which the black is detected.

In this situation, the black straight line L11 is exposed in the area on which the straight line L55*a* is not printed. Therefore, when the black is detected by the optical sensor 5, it is possible to reliably detect whether or not the straight line 55*a* is printed.

Further, in this case, the plurality of straight lines L55*a* are printed after it is judged that the ink discharge malfunction does not arise in all of the nozzles 10 for discharging the inks other than the white in S302 described above. Therefore, the straight lines L11 are reliably printed on the area on which the straight lines L55*a* are to be printed. Therefore, it is possible to correctly judge whether or not the ink discharge malfunction arises in the nozzle or nozzles 10 for constructing the nozzle array 7*e* depending on whether or not the black is detected by the optical sensor 5 in S305 described above.

Further, the plurality of straight lines 55*a* are printed on the straight lines L11 for constructing the second judgment pattern A11. That is, the first judgment pattern, which indicates whether or not the ink discharge malfunction arises in the nozzle or nozzles 10 for constructing the nozzle array 7*e*, is printed by utilizing the second judgment pattern A11. Therefore, it is unnecessary to distinctly land the black ink droplets on any area of the recording paper P different from the areas on which the second judgment patterns A11 to A14 are to be printed.

When the ink discharge malfunction arises in any one of the nozzles 10 for constructing the nozzle array 7*e* (S305: NO), the maintenance, which includes, for example, the flashing and the purge, is performed for the concerning nozzle 10 (S306), and then the routine returns to S304 described above.

Figure 13D:
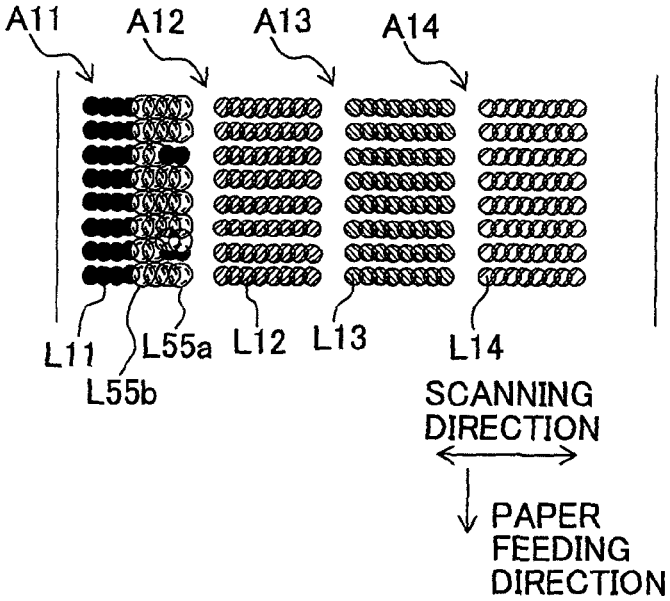
FIG. 13D shows S304 step after performing 5306 step.

However, in this case, in S304, as shown in FIG. 13D, the plurality of straight lines, which are the same as or equivalent to the straight lines L55*a*, are printed on the portions of the plurality of straight lines L11 for constructing the second judgment pattern A11, the portions being different from the portions on which the plurality of straight lines L55*a* are printed. In S305 described above, the judging section 53 judges whether or not the ink discharge malfunction arises in the nozzle or nozzles 10 for constructing the nozzle array 7*e* depending on whether or not the black is detected in the area on which the plurality of concerning straight lines are to be printed, by the optical sensor 5. FIG. 13D shows the case in which the plurality of straight lines L55*b* are printed on the portions adjacent to the left sides of the portions on which the plurality of straight lines L55*a* are printed by way of example. In this case, the portions of the plurality of straight lines L11 on which the plurality of straight lines L55*b* are printed and the plurality of straight lines L55*b* correspond to the first judgment pattern according to the present teaching.

When it is judged that the ink discharge malfunction does not arise in all of the nozzles 10 for constructing the nozzle array 7*e* (S305: YES), the operation is completed.

The position, at which the optical sensor 5 is arranged, is not limited to any specified position. The optical sensor 5 can be arranged at any arbitrary position provided that the printed first and second judgment patterns can be detected. For example, a line-shaped optical sensor 5 may be arranged so that the line-shaped optical sensor 5 is fixed in the direction intersecting the paper feeding direction of the recording paper P. Preferably, the optical sensor 5 is placed on the carriage 2 together with the ink-jet head 3. In this case, it is possible to detect the portions of the first and second judgment patterns on which the inks are landed immediately after the inks are landed on the recording paper P.

Fifth Modified Embodiment

Figure 14:
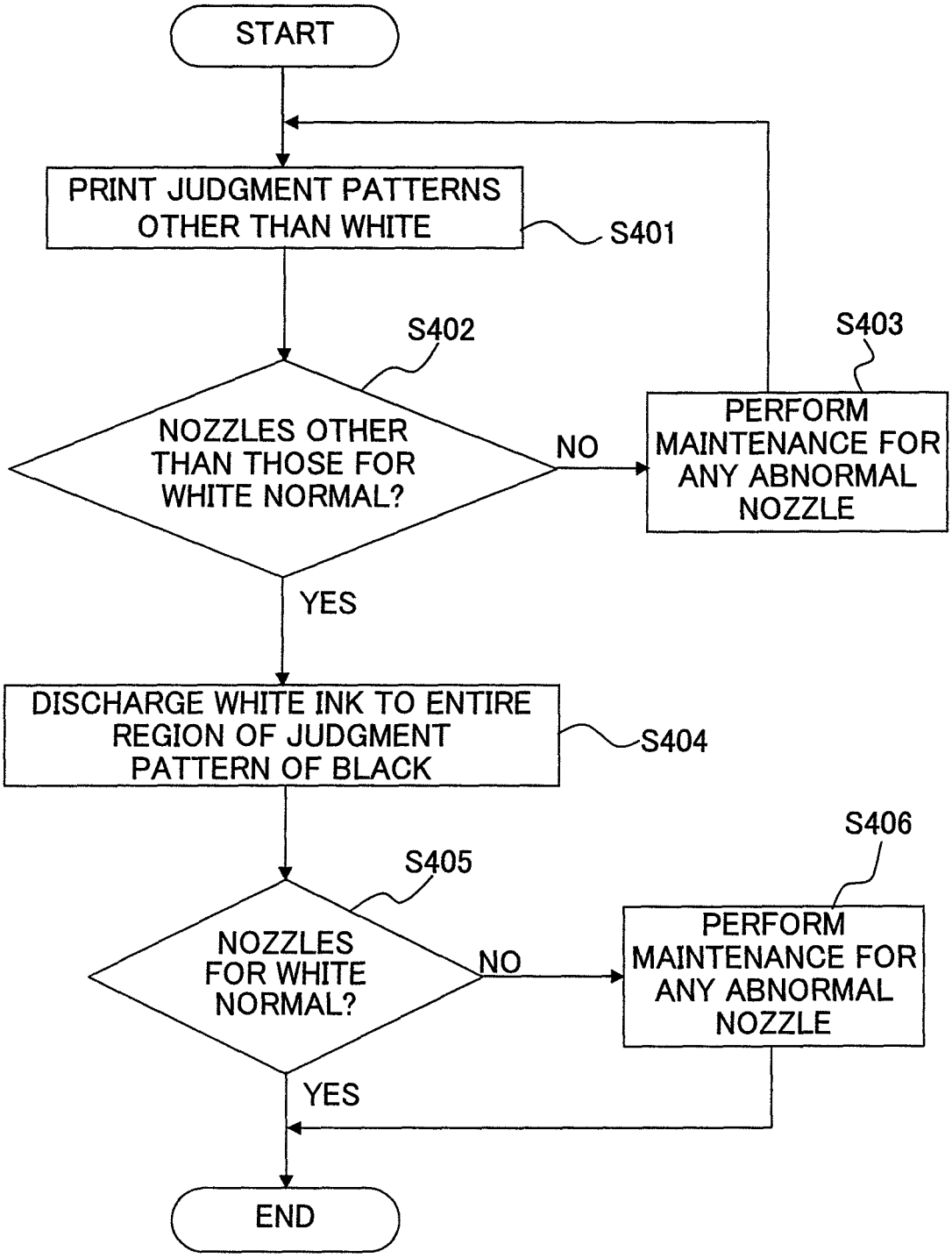
FIG. 14 shows a flow chart corresponding to FIG. 4 in a fifth modified embodiment.
Figure 15A:
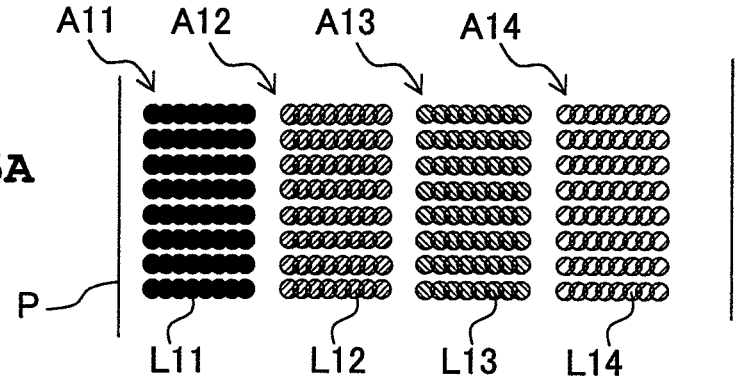
FIG. 15A shows S401 step.
Figure 15B:
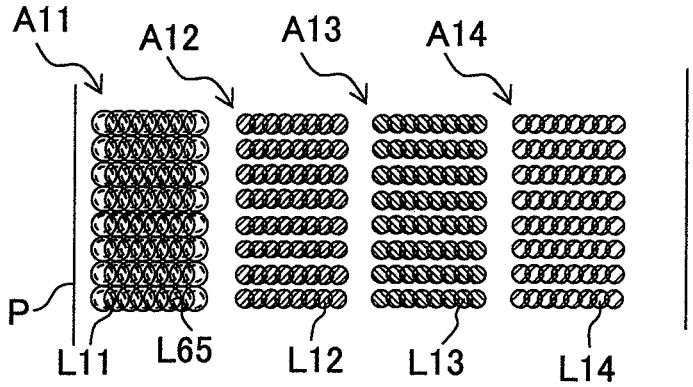
FIG. 15B shows S404 step in which no ink discharge malfunction arises in nozzles for discharging the white ink.

As shown in FIG. 14, in the same manner as in the fourth modified embodiment, the second judgment patterns A11 to A14 are printed as shown in FIG. 15A, it is judged whether or not the ink discharge malfunction arises in the plurality of nozzles 10 for constructing the nozzle arrays 7*a* to 7*d* for discharging the inks other than the white, and the maintenance is performed (S401 to S403). After that, as shown in FIG. 15B, a plurality of straight lines L65, which cover the plurality of straight lines L11 for constructing the second judgment pattern A11 over the entire lengths thereof, are printed (S404). In this process, the straight lines L65 are formed such that the white ink droplets, which have the volumes larger than those of the ink droplets for constructing the straight lines L11, are landed while being aligned in the scanning direction.

Figure 15C:
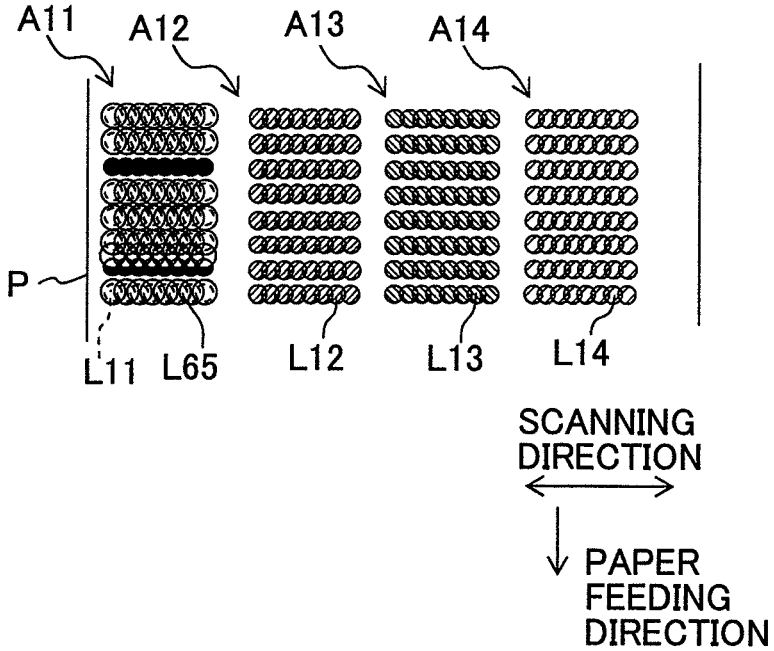
FIG. 15C shows S404 step in which the ink discharge malfunction arises in nozzles for discharging the white ink.

In this process, when the ink discharge malfunction does not arise in the nozzles 10 for constructing the nozzle array 7*e*, as shown in FIG. 15B, all of the plurality of straight lines L11 are white by being covered with the plurality of straight lines L65. When the ink discharge malfunction arises in the nozzle or nozzles 10 for constructing the nozzle array 7*e*, as shown in FIG. 15C, any one of the right end portions of the straight lines L11 is exposed, for example, such that any one of the straight lines L65 is not printed. FIG. 15C shows an example in which the discharge failure arises in the third nozzle as counted from the top of the nozzles 10 for constructing the nozzle array 7*e*, and the bending of the ink discharge arises in the second nozzle as counted from the bottom.

Subsequently, the judging section 53 judges whether or not the ink discharge malfunction arises in the nozzle or nozzles 10 for constructing the nozzle array 7*e* (S405).

Specifically, when the optical sensor 5 does not detect the black in the area on which the plurality of straight lines L11, L65 are printed, it is judged that the ink discharge malfunction does not arise in the nozzles 10 for constructing the nozzle array 7*e*. When the optical sensor 5 detects the black, it is judged that the ink discharge malfunction arises in the nozzle or nozzles 10 corresponding to the straight line or straight lines 65 to be printed on the area on which the black is detected.

When it is judged that the ink discharge malfunction does not arise in all of the nozzles 10 for constructing the nozzle array 7*e* (S405: YES), the operation is completed as it is in the same manner as in the fourth modified embodiment. When it is judged that the ink discharge malfunction arises in any one of the nozzles 10 for constructing the nozzle array 7*e* (S405: NO), then the maintenance is performed for the concerning nozzle 10 (S406) unlike the fourth modified embodiment, and then it is regarded that the ink discharge malfunction is dissolved in the concerning nozzle 10 to complete the operation.

Also in this case, the black straight line L11 is exposed to the area on which the straight line L65 is not printed in the same manner as in the fourth modified embodiment. Therefore, when the black is detected by the optical sensor 5, it is possible to reliably detect whether or not the straight line L65 is printed.

Further, the plurality of straight lines L65 are printed after it is judged that the ink discharge malfunction does not arise in all of the nozzles 10 for discharging the inks other than the white in S402. Therefore, it is denied that the white is provided due to the failure of the printing of the straight line L11 at the position at which the straight line L65 is to be printed. Therefore, it is possible to correctly judge whether or not the ink discharge malfunction arises in the nozzle or nozzles 10 for constructing the nozzle array 7*e* in S405.

The first judgment pattern, which indicates whether or not the ink discharge malfunction arises in the nozzle or nozzles 10 for constructing the nozzle array 7*e*, is printed by printing the plurality of straight lines L65 on the straight lines L11 for constructing the second judgment pattern A11, i.e., by utilizing the second judgment pattern A11. Therefore, it is unnecessary to distinctly land the black ink on the area different from the area of the recording paper P on which the second judgment patterns A11 to A14 are printed.

In the fourth and fifth modified embodiments, the plurality of straight lines L55*a*, L55*b*, L65 are printed on the plurality of straight lines L11 for constructing the second judgment pattern A11 in S304 and S404. However, the present invention is not limited thereto. The first judgment pattern may be printed in S304 and S404 such that a plurality of straight lines, which are the same as or equivalent to the plurality of straight lines L11, are printed on an area different from the areas on which the second judgment patterns A11 to A14 are printed, and straight lines, which are the same as or equivalent to the straight lines L55*a*, L55*b*, L65, are printed on the straight lines.

When the first judgment pattern is printed distinctly as described above, the recording paper P, on which the second judgment patterns A11 to A14 are printed, may be discharged after judging that the ink discharge malfunction does not arise in the nozzles 10 for constructing the nozzle arrays 7*a* to 7*d* in S303 and S403, and the first judgment pattern may be printed on another sheet of the recording paper P.

In the fifth modified embodiment, the plurality of straight lines L65 are printed on the plurality of straight lines L11 for constructing the second judgment pattern A11 in S404. However, the present invention is not limited thereto. The first judgment pattern may be printed by printing the straight lines L65 on all of the plurality of straight lines L11 to L14 for constructing the second judgment patterns A11 to A14. According to this procedure, when all of the nozzles 10 are normal, the following recording paper P is discharged. That is, the portions, on which the black, cyan, magenta, and yellow ink droplets are landed, are covered with the white ink, and the entire regions are white. Therefore, the recording paper P can be reused, for example, for the judgment pattern printing to be performed next time.

In the embodiment described above and the first to third modified embodiments, it is judged that whether or not the ink discharge malfunction arises in the nozzle or nozzles 10 by visually confirming the judgment patterns by the user. However, in such cases, the judgment as described above may be also made by means of the judging section 53 according to the detection result obtained by the optical sensor 5.

In such cases, in the embodiment and the first and second modified embodiments, it is possible to judge whether or not the ink discharge malfunction arises in the nozzle or nozzles 10 depending on whether or not the black is detected in the areas on which the straight lines L15, L25, L35 are to be printed, by means of the optical sensor 5 respectively. In the third modified embodiment, it is possible to judge whether or not the ink discharge malfunction arises in the nozzle or nozzles 10 depending on whether or not the black, cyan, magenta, and/or yellow is/are detected in the area on which the straight lines L45 are to be printed, by means of the optical sensor 5.

On the other hand, conversely to the above, in S302 and S402 described above in the fourth and fifth modified embodiments, the second judgment patterns A11 to A14 may be visually confirmed, and it may be judged whether or not the ink discharge malfunction arises in the nozzle or nozzles 10 for constructing the nozzle arrays 7*a* to 7*d* depending on whether or not all of the straight lines L11 to L14 are printed. In S305 and S405 described above, the first judgment pattern, which is printed with the straight lines L55*a*, L55*b*, L65, may be visually confirmed, and it may be judged whether or not the ink discharge malfunction arises in the nozzle or nozzles 10 for constructing the nozzle array 7*e* depending on whether or not all of the straight lines L55*a*, L55*b*, L65 are printed (whether or not the straight line L11 is exposed).

In the first to fifth modified embodiments, the white ink droplets, which have the volumes larger than those of the other ink droplets, are landed respectively on the same positions as the positions on the recording paper P on which the ink droplets of the black (black, cyan, magenta, and yellow in the case of the third modified embodiment) for constructing the straight lines L26, L36 are landed. However, it is not necessarily indispensable that the landing positions of the white ink droplets should be coincident with the landing positions of the ink droplets disposed thereunder, provided that the white ink droplets can completely cover the ink droplets landed thereunder. When the discharge direction of the ink from the nozzle 10 is not deviated, the volumes of the white ink droplets may be approximately the same as the volumes of the ink droplets having been landed previously.

In the foregoing description, the first judgment pattern, which indicates whether or not the ink discharge malfunction arises in the nozzle or nozzles 10 for constructing the nozzle array 7*e* for discharging the white ink, is printed by printing the white straight lines on the black underlayer or the straight lines having the largest color difference as compared with the white. However, the color (second color) of the underlayer or the straight lines printed under or below the white straight lines may be any one of cyan, magenta, and yellow.

The foregoing description is illustrative of the exemplary case in which the judgment pattern, which indicates whether or not the ink discharge malfunction arises in the nozzle or nozzles 10 for discharging the white ink, is printed on the white recording paper P. However, the present teaching is not limited thereto.

For example, when the ink-jet head 3 is constructed so that the ink of the color (first color) having the small color difference from the color of the recording paper P as compared with the black, cyan, magenta, and yellow can be discharged in place of the white ink, it is also allowable to print the first judgment pattern which indicates whether or not the ink discharge malfunction arises in the nozzle or nozzles 10 for discharging the ink of the concerning color.

When the first judgment pattern, which indicates whether or not the ink discharge malfunction arises in the nozzle or nozzles 10 for discharging the ink of the color (first color) having the smallest color difference with respect to the color of the recording paper P when the color of the recording paper P is the same as any one of the black, cyan, magenta, and yellow or when the color of the recording paper P has the small color difference with respect to these colors, then the underlayer B or the straight lines L26, L36 may be printed by landing the ink of the color (second color) other than the concerning color on the recording paper P, and the straight lines L15, L25, L35, L45, L55*a*, L55*b*, L65 may be printed by landing the ink of the concerning color thereon.

When the color (first color) of the ink colors, which has the smallest color difference as compared with the color of the recording paper P, is determined depending on the color of the recording paper P, then the user may specify the ink of the first color based on the color of the recording paper P, or the user may input the information about the color of the recording paper P into the printer 1 to specify the ink of the first color by means of the judging section 53 of the control unit 50 on the basis of the inputted information.

Alternatively, when the printer 1 is provided with the optical sensor 5, then the optical sensor 5 may detect the color of the recording paper P, and the judging section 53 of the control unit 50 may specify the ink of the first color on the basis of the color information of the recording paper P detected by the optical sensor 5. In this case, the judging section 53 may judge whether or not the magnitude of the color difference between the color of the recording paper P and the first color exceeds a predetermined threshold value, and the mode of the printing of the judgment pattern may be changed on the basis of an obtained result. The predetermined threshold value may be determined on the basis of whether or not the user (or the optical sensor 5) can easily distinguish the presence or absence of the ink of the first color when the ink of the first color is landed directly on the recording paper P. For example, when the magnitude of the color difference between the color of the recording paper P and the first color is smaller than the predetermined threshold value, the judging section 53 may judge that the ink of the first color is hardly observed (hardly detected) if the ink of the first color is landed directly on the recording paper P. In this case, as described above, the judgment pattern printing control section 52 may print the first and second judgment patterns while landing the ink of the second color before landing the ink of the first color. On the other hand, when the magnitude of the color difference between the color of the recording paper P and the first color is greater than the predetermined threshold value, the judging section 53 may judge that the ink of the first color is not hardly observed (not hardly detected) even when the ink of the first color is landed directly on the recording paper P. In this case, the judgment pattern printing control section 52 may print the predetermined judgment pattern while landing the inks of all of the colors directly on the recording paper P.

For example, the following case is assumed, in which the printer 1 is provided with the four color inks of black, cyan, magenta, and yellow. When the white recording paper P is used, the color of the ink, which has the smallest color difference as compared with the color of the recording paper P, is yellow. However, the color difference between the white and the yellow is not small to such an extent that the yellow ink cannot be recognized even when the yellow ink is directly landed on the recording paper P. Accordingly, when the optical sensor 5 detects that the color of the recording paper P is white, the judgment pattern printing control section 52 may print the predetermined judgment pattern while directly landing the respective inks of black, cyan, magenta, and yellow on the recording paper P. When the light green recording paper P is used, the color of the ink, which has the smallest color difference as compared with the color of the recording paper P, is yellow. In this case, the color difference between the light green and the yellow is small to such an extent that the yellow ink cannot be recognized when the yellow ink is directly landed on the recording paper P. Accordingly, when the optical sensor 5 judges that the color of the recording paper P is light green, the judgment pattern printing control section 52 may print the first and second judgment patterns while landing the ink of the second color (for example, the black ink) before landing the yellow ink. It is not necessarily indispensable that the optical sensor 5 should detect the color of the entire recording paper P. For example, the color of the area on which the judgment pattern is intended to be printed may be detected by the optical sensor 5, and the judging section 53 may judge whether or not the magnitude of the color difference exceeds the threshold value as described above on the basis of the color difference between the detected color of a part of the recording paper P and the color of each of the inks.

As described above, the optical sensor 5 may also function as the sensor for detecting the color of the recording paper P. Alternatively, a sensor for detecting the color of the recording paper P may be provided independently from the optical sensor 5.

In the foregoing description, the ink-jet head 3 is capable of discharging the five types of inks which have the mutually different colors. However, the ink-jet head may be capable of discharging inks of two to four types or six or more types which have mutually different colors. The embodiment and the modified embodiments described above have been explained as exemplified by the ink-jet printer for discharging the inks to the recording paper by way of example. However, the present teaching is not limited thereto. The present invention is widely applicable, for example, to printers for discharging inks to recording media other than the paper including, for example, cloths such as T-shirt, vinyl base materials, and plastic plates.

What is claimed is:

1. A printer which performs printing by discharging, to a medium, inks of a plurality of colors including an ink of a first color which has a smallest color difference from a color of the medium and an ink of a second color which is different from the first color, the printer comprising:

an ink-jet head which is formed with a plurality of nozzles including a plurality of first nozzles through which the ink of the first color is discharged and a plurality of second nozzles through which the ink of the second color is discharged; and a control unit which controls operation of the ink-jet head, the control unit including a judgment pattern printing control section which controls the ink-jet head while printing a first judgment pattern which indicates whether or not ink discharge malfunction arises in the first nozzles, the judgment pattern printing control section controlling the ink-jet head to discharge ink droplets of the second color from the second nozzles to an area of the medium, and then to discharge ink droplets of the first color from the first nozzles toward the entire area on which the ink droplets of the second color are landed to print the first judgment pattern on the area, so that the ink droplets of the first color land on and entirely covet the entire area on the medium, on which the ink droplets of the second color have been landed and dried on the medium;

wherein the judgment pattern printing control section controls the ink-jet head so that the ink droplets of the first color, which have volumes larger than those of the ink droplets of the second color discharged from the second nozzles, are discharged from the first nozzles, while the first judgment pattern is printed.

2. The printer according to claim 1;

wherein the judgment pattern printing control section controls the ink-jet head so that the number of the ink droplets of the first color discharged from the first nozzles is same as that of the ink droplets of the second color discharged from the second nozzles, and that a position at which the ink droplets of the first color are landed on the medium is same as a position at which the ink droplets of the second color are landed on the medium, while the first judgment pattern is printed.

3. The printer according to claim 1;

wherein the judgment pattern printing control section controls the ink-jet head so that a second judgment pattern, which indicates whether or not ink discharge malfunction arises in the second nozzles, is printed by further discharging the ink droplets of the second color from the second nozzles to an area of the medium different from the area on which the first judgment pattern is printed.

4. The printer according to claim 3;

wherein the judgment pattern printing control section controls the ink-jet head so that the second judgment pattern is printed on an area, of the medium, disposed adjacently to the area on which the first judgment pattern is printed.

5. The printer according to claim 1, further comprising:

a color sensor which detects a color of the first judgment pattern;

wherein the control unit further includes a judging section which judges whether or not ink discharge malfunction arises in the nozzles based on a detection result obtained by the color sensor;

wherein the judgment pattern printing control section makes the second nozzles discharge the ink droplets of the second color therefrom to the medium to print a second judgment pattern which indicates whether or not ink discharge malfunction arises in the second nozzles;

wherein the judging section judges whether or not the ink discharge malfunction arises in the second nozzles with the color sensor based on whether or not the color of the medium is detected at a position, in the second judgment pattern, at which the ink droplets of the second color are to be landed; and wherein, under a condition that the judging section judges that the ink discharge malfunction does not arise in the second nozzles, the judgment pattern printing control section controls the ink-jet head so that the first judgment pattern is printed, at the area of the medium on which the ink droplets of the second color are landed, by discharging the ink droplets of the first color from the first nozzles toward the area.

6. The printer according to claim 5;

wherein, the ink-jet head has a plurality of third nozzles through which an ink of a third color different from the first and second colors is discharged; and wherein the judgment pattern printing control section controls the ink-jet head so that ink droplets of the second and third colors are discharged to mutually different areas of the medium from the second and third nozzles respectively to print the second judgment pattern, and that then the ink droplets of the first color are discharged from the first nozzles to at least parts of the areas on which the ink droplets of the second and third colors are landed respectively to print the first judgment pattern.

7. The printer according to claim 5, further comprising:

a carriage which supports the color sensor and the ink-jet head and which is provided movably with respect to the medium, and a driving mechanism which drives the carriage.

8. The printer according to claim 1;

wherein the second color has a largest color difference from the color of the medium, among the colors of the inks to be discharged from the plurality of nozzles.

9. The printer according to claim 1;

wherein both of the color of the medium and the first color are white.

10. The printer according to claim 1, further comprising:

a second color sensor which detects a color of at least a part of an area of the medium, wherein the judging section selects the ink of the first color from the inks of the plurality of colors based on a detection result obtained by the second color sensor and judges whether or not a magnitude of a color difference between the first color and the detected color of at least the part of the area of the medium is greater than a predetermined threshold value; and wherein under a condition that the judging section judges that the magnitude of the color difference is greater than the threshold value, the judgment pattern printing control section controls the ink-jet head so that the ink droplets of the first color are directly landed on the medium from the first nozzles to print the first judgment pattern.

11. The printer according to claim 10;

wherein the color sensor functions also as the second color sensor.

12. A printer which performs printing by discharging, to a medium, inks of a plurality of colors including an ink of a first color which has a smallest color difference from a color of the medium and an ink of a second color which is different from the first color, the printer comprising:

an ink-jet head which is formed with a plurality of nozzles including a plurality of first nozzles through which the ink of the first color is discharged and a plurality of second nozzles through which the ink of the second color is discharged; and a control unit which controls operation of the ink-jet head, the control unit including a judgment pattern printing control section which controls the ink-jet head while printing a first judgment pattern which indicates whether or not ink discharge malfunction arises in the first nozzles, the judgment pattern printing control section controlling the ink-jet head so that ink droplets of the second color are discharged from the second nozzles to an area of the medium, and that then ink droplets of the first color are discharged from the first nozzles toward the area of the medium on which the ink droplets of the second color are landed to print the first judgment pattern on the area;

wherein the judgment pattern printing control section controls the ink-jet head so that the ink of the first color is discharged from the first nozzles to an entire area of the medium on which the ink droplets of the second color are landed, while the first judgment pattern is printed;

wherein the judgment pattern printing control section controls the ink-jet head so that the number of the ink droplets of the first color discharged from the first nozzles is same as that of the ink droplets of the second color discharged from the second nozzles, and that a position at which the ink droplets of the first color are landed on the medium is same as a position at which the ink droplets of the second color are landed on the medium, while the first judgment pattern is printed; and wherein the judgment pattern printing control section controls the ink-jet head so that the ink droplets of the first color, which have volumes larger than those of the ink droplets of the second color discharged from the second nozzles, are discharged from the first nozzles, while the first judgment pattern is printed.

* * * * *